US007278248B2

(12) United States Patent
Vinh Le

(10) Patent No.: US 7,278,248 B2
(45) **Date of Patent: *Oct. 9, 2007**

(54) CASE SEALER WITH MOVING FLAP CLOSERS

(76) Inventor: Tuan Vinh Le, 3695 Kaneff Crescent, Suite 2006, Mississauga, Ontario (CA) L5A 4B6

( * ) Notice: Subject to any disclaimer, the term of this patent is extended or adjusted under 35 U.S.C. 154(b) by 96 days.

This patent is subject to a terminal disclaimer.

(21) Appl. No.: 11/167,479

(22) Filed: Jun. 27, 2005

(65) Prior Publication Data

US 2005/0235603 A1 Oct. 27, 2005

Related U.S. Application Data

(63) Continuation-in-part of application No. 10/330,268, filed on Dec. 30, 2002, now Pat. No. 6,910,314.

(51) Int. Cl.
*B65B 61/00* (2006.01)

(52) U.S. Cl. ..... 53/136.4; 53/75; 53/136.3; 53/377.2; 53/378.3; 493/117; 493/147

(58) Field of Classification Search ..... 53/136.4, 53/136.3, 136.1, 372.2, 378.3, 491, 415, 53/282; 493/117, 147
See application file for complete search history.

(56) References Cited

U.S. PATENT DOCUMENTS

| | | | | |
|---|---|---|---|---|
| 1,887,699 | A | 11/1932 | Reid | |
| 3,282,018 | A | 11/1966 | Bixley | |
| 3,466,843 | A | 9/1969 | Mumper | |
| 3,775,937 | A | 12/1973 | Devan et al. | |
| 3,894,380 | A | 7/1975 | Poulsen | |
| 4,161,138 | A | 7/1979 | Marchetti | |
| 4,218,862 | A | 8/1980 | Marchetti | |
| 4,262,468 | A | 4/1981 | Marchetti | |
| 4,293,086 | A | 10/1981 | Fincher et al. | |
| 4,317,319 | A | 3/1982 | Price | |
| 4,554,042 | A | 11/1985 | Marchetti | |
| 4,585,504 | A | 4/1986 | Marchetti | |
| 4,722,165 | A | 2/1988 | Marchetti | |
| 5,099,979 | A | 3/1992 | Kehrel | |
| 5,323,586 | A | 6/1994 | Lissoni et al. | |
| 5,511,362 | A * | 4/1996 | Morita et al. | 53/491 |
| 5,685,814 | A | 11/1997 | Le | |
| 5,772,568 | A * | 6/1998 | Chen | 493/116 |
| 5,839,254 | A * | 11/1998 | Chen | 53/377.2 |
| 5,916,106 | A | 6/1999 | Chen | |
| 6,067,773 | A | 5/2000 | Le | |
| 6,318,048 | B1 | 11/2001 | Sambuca, Jr. | |
| 6,319,183 | B1 | 11/2001 | Ballos, III | |
| 6,604,337 | B2 | 8/2003 | Close et al. | |

(Continued)

FOREIGN PATENT DOCUMENTS

| | | |
|---|---|---|
| EP | 0 667 287 | 8/1995 |

(Continued)

*Primary Examiner*—Thanh Truong
(74) *Attorney, Agent, or Firm*—Butxel Long

(57) ABSTRACT

A case sealer has a frame with a conveyor for moving boxes into a pair of spaced-apart lateral conveyors. A floating head located over the lateral conveyors folds the box end and side flaps into a closed position. A seal dispensing platform carrying a tape dispenser seals the box flaps shut.

9 Claims, 19 Drawing Sheets

U.S. PATENT DOCUMENTS

| | | | | |
|---|---|---|---|---|
| 6,702,728 | B1 * | 3/2004 | Ballos, III | 493/116 |
| 6,926,652 | B2 * | 8/2005 | Marchetti | 493/80 |
| 2004/0226268 | A1 * | 11/2004 | Vinh Le | 53/491 |
| 2005/0126123 | A1 * | 6/2005 | Chase et al. | 53/415 |

FOREIGN PATENT DOCUMENTS

| | | |
|---|---|---|
| FR | 1438303 | 4/1966 |
| GB | 949343 | 2/1964 |
| GB | 1048674 | 11/1966 |

* cited by examiner

CASE SEALER WITH MOVING FLAP CLOSERS

RELATED APPLICATION INFORMATION

This application is a continuation-in-part of U.S. patent application Ser. No. 10/330,268, filed on Dec. 30, 2002, now U.S. Pat. No. 6,910,314.

BACKGROUND OF THE INVENTION

This invention relates to box or case sealers for closing the open ends of cardboard boxes or cartons.

In the packaging industry, many products are packed in cardboard boxes or cartons for shipping. Often, one end of the box, namely the bottom, is sealed shut before the box is filled, and after the box is filled, the open top end of the box usually has end and side flaps that are folded inwardly and downwardly. The box can be sealed by applying glue to the inside of the mating surfaces of the folded flaps prior to them being folded shut, or by applying tape to the outside of the flaps after they have been folded shut.

In many cases, the boxes are uniform in size, so providing apparatus that will fold the flaps and apply adhesive or tape thereto is not particularly difficult to do. The apparatus can be adjusted to suit the known width and the height of the boxes and there is usually no problem running the boxes through the case sealer once it has been adjusted properly.

However, sometimes the boxes are of different sizes coming down the same conveyor line. In these instances, a random case sealer is required, wherein the apparatus for folding the box flaps and applying adhesive or tape thereto adjusts automatically to suit the size of the box.

In prior art random case sealers, various sensors have been used to try to determine the exact size or position of the boxes entering the case sealer, and numerous actuators or other adjust mechanisms together with suitable control devices, have been used to adjust the position of the various folding and sealing components to suit the position and size of the box being sealed. A difficulty with this type of apparatus however, is that the boxes are often misshaped or underfilled or overfilled, so that they are not uniform in shape so the sensors often cannot determine the optimum position adjustments. The result is that the boxes get jammed in the apparatus shutting down the packaging line.

The jamming problem was largely overcome by the box sealer apparatus described in U.S. Pat. No. 5,685,814 issued to Tuan Vinh Le. In this patent, the folding and sealing components of the apparatus are gravitationally biased and positioned by contact with the actual box being sealed, so any variations in the shape of the box are automatically accommodated. Sometimes, however, the cardboard or box board used to make the cartons is not as thick or strong as it should be, or the boxes are underfilled, in which case the boxes can still be deformed during the sealing operation with undesirable results.

SUMMARY OF THE INVENTION

In the present invention, the folding and sealing components of the apparatus are positioned by contact with the actual box being sealed, thus accommodating non-uniformity of the boxes, yet the forces on the box components are controlled, so as to avoid the application of excessive force to the boxes. In other embodiments, the end flap closer moves to accommodate boxes of varying length. In yet other embodiments, side flap closers move to accommodate boxes of varying width. The side flap closers may be pivotable to reduce the angle of attack in relation to a box being sealed.

According to one aspect of the invention, there is provided a case sealer comprising a frame having a longitudinal axis and including an entrance conveyor for moving boxes entering the case sealer along the axis. A pair of longitudinal spaced-apart, lateral conveyors is located to receive boxes from the entrance conveyor. A floating head is spaced above the lateral conveyors. The floating head includes: an upwardly inclined entry ramp adapted to engage and fold inwardly a forward end flap on a box; means for raising and lowering the floating head to suit the height of the box; a pivoting arm assembly including a pivot arm pivotable downwardly after the box passes thereunder to fold inwardly a rearward end flap on the box; a boom extending over the entrance conveyor having a distal end, the pivot arm assembly being slidably mounted on the boom; means for sliding the pivoting arm assembly along the boom to accommodate and close the end flaps of boxes of varying length; and diverging side bars for engaging and folding inwardly side flaps on the box after the rearward end flap has been folded inwardly. A seal dispensing platform is located downstream of the lateral conveyors. The seal dispensing platform includes holding means for holding box flaps shut, and is adapted to mount a seal dispenser centrally thereon for sealing the box flaps shut.

According to another aspect of the invention, there is provided a case sealer comprising a frame having a longitudinal axis and including an entrance conveyor for moving boxes entering the case sealer along the axis. A pair of longitudinal spaced-apart, lateral conveyors is located to receive boxes from the entrance conveyor. A floating head is spaced above the lateral conveyors. The floating head includes: an upwardly inclined entry ramp adapted to engage and fold inwardly a forward end flap on a box; means for raising and lowering the floating head to suit the height of the box; a pivoting arm assembly pivotable downwardly after the box passes thereunder to fold inwardly a rearward end flap on the box; a transverse member extending transverse to the longitudinal axis of the frame; diverging side bars slideably mounted to the transverse member for engaging and folding inwardly side flaps on the box after the rearward end flap has been folded inwardly; and means for sliding the side bars along the transverse member to accommodate and close the side flaps of boxes of varying width. A seal dispensing platform is located downstream of the lateral conveyors. The seal dispensing platform includes holding means for holding box flaps shut, and is adapted to mount a seal dispenser centrally thereon for sealing the box flaps shut.

Other aspects and features of the present invention will become apparent to those ordinarily skilled in the art upon review of the following description of specific embodiments of the invention in conjunction with the accompanying figures.

BRIEF DESCRIPTION OF THE FIGURES

Embodiments of the invention will now be described, by way of example, with reference to the accompanying drawings, in which.

Figure 1:
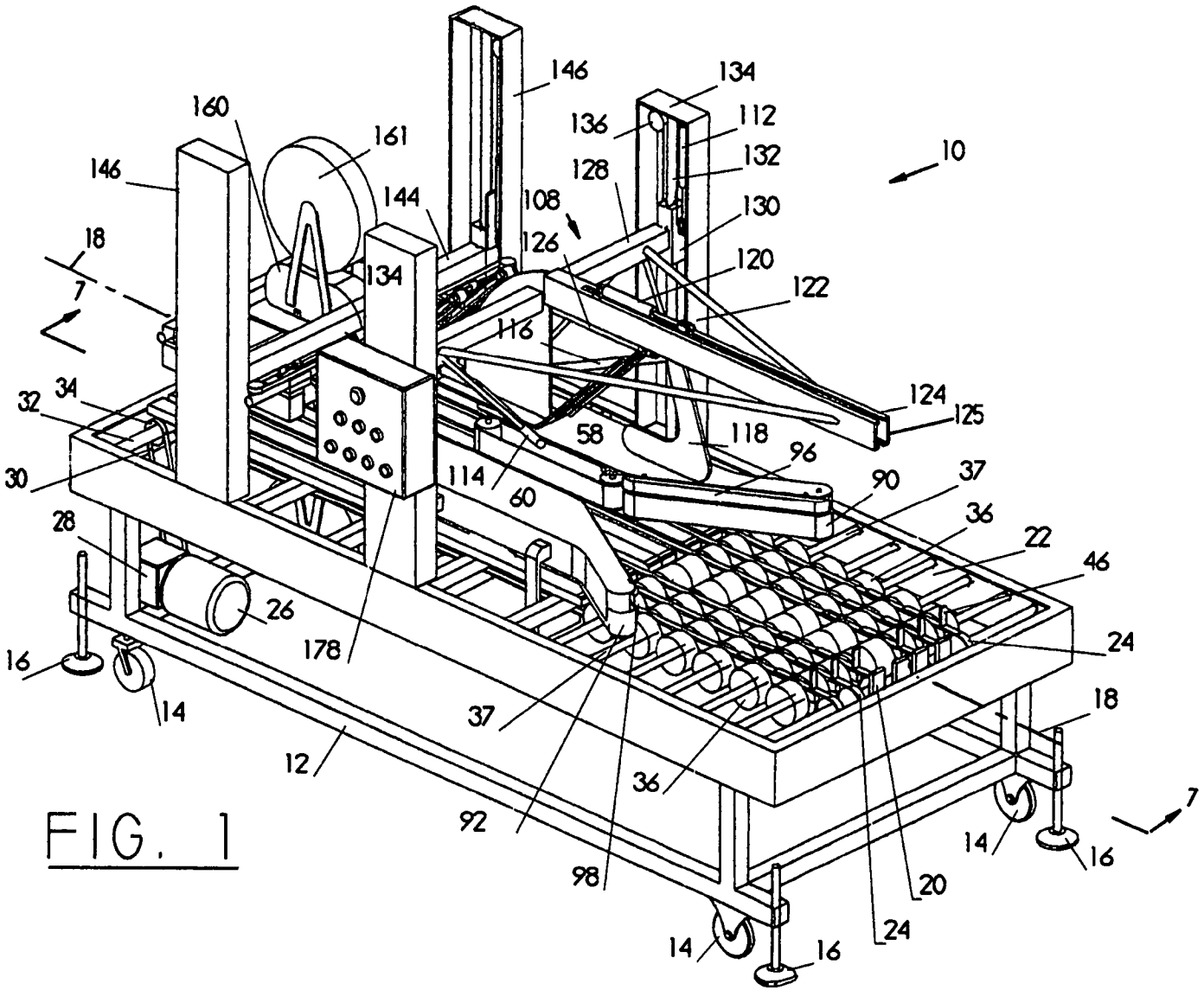
FIG. 1 is a perspective view taken from above and from the entrance end of one embodiment of a case sealer according to the present invention.

Similar references are used in different figures to denote similar components.

DETAILED DESCRIPTION OF THE EMBODIMENTS

Referring to the drawings, a preferred embodiment of a case sealer according to the present invention is generally indicated in the drawings by reference numeral 10. Case sealer 10 includes a frame 12 mounted on castors 14, so that the case sealer is easily transportable or movable from one packaging line to another. Retractable feet 16 are threadably mounted in frame 12 to engage the floor and make case sealer stationary, if desired. Frame 12 has a longitudinal axis 18 which indicates the direction in which boxes or cartons or cases travel to be closed and sealed shut in case sealer 10.

Case sealer 10 is normally located adjacent to a packaging line (not shown) to close and seal, one at a time, filled boxes received from such a packaging line. However, boxes or cartons could be manually placed on case sealer 10 if desired. Where the cases are received from a packaging line, a gate mechanism 20 can be provided to space the cases apart prior to being closed and sealed, as will be described further below. However, the gate mechanism could be provided on the end of the packaging line rather than on case sealer 10, if desired.

Case sealer 10 includes an entrance conveyor 22 which has a plurality of spaced-apart, longitudinal endless conveyor chains or belts 24. Conveyor chains 24 extend the full length of case sealer 10. Chains 24 are driven by a motor 26 and gear box 28 driving another drive chain 30, which in turn rotates a shaft 32 having a sprocket 34 mounted thereon. Shaft 32 has additional sprockets 34 to drive each of the continuous chains 24. Chains 24 operate at speeds typically between about 15 to 25 meters per minute, sometimes between about 25 and 35 meters per minute.

Entrance conveyor 22 also includes a plurality of rollers 36 located between conveyor chains 24 to support the boxes thereon. Rollers 36 are driven by chains 24 using suitable sprockets attached thereto or to the shafts 37 on which the rollers are mounted.

Figures 3, 9, 10:
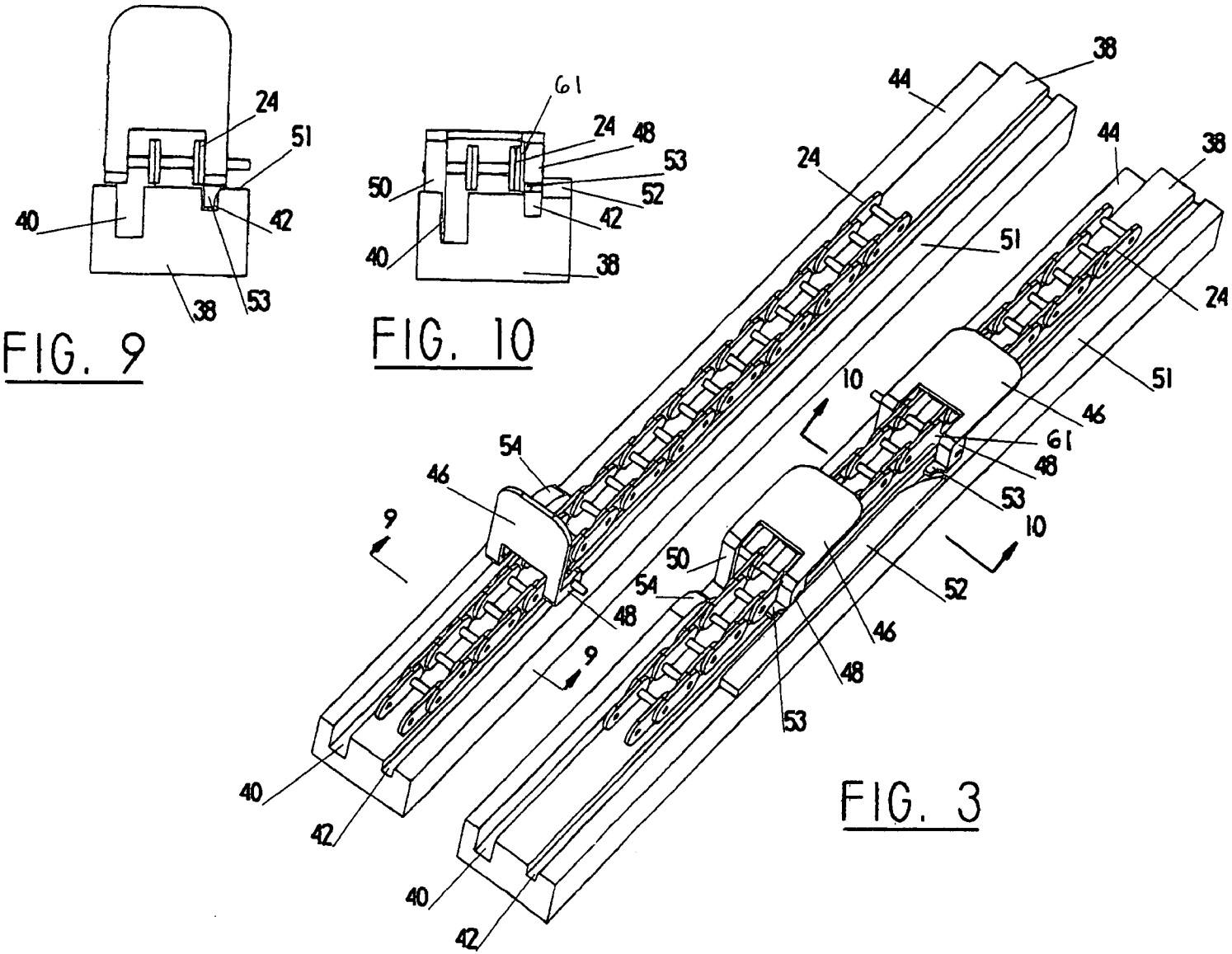
FIG. 3 is an enlarged perspective view of a portion of the entrance conveyor of the case sealer of FIGS. 1 and 2.
FIG. 9 is a sectional view taken along lines 9-9 of FIG. 3.
FIG. 10 is a sectional view taken along lines 10-10 of FIG. 3.

With reference to FIGS. 3, 9 and 10 it will be seen that conveyor chains 24 travel along tracks 38 which extend longitudinally along the length of case sealer 10. Tracks 38 have a pair of longitudinal grooves 40, 42 formed therein. Grooves 40 have a widened portion or shelf 44 located at the ends of tracks 38 adjacent to the entrance of case sealer 10. Conveyor chains 24 have pushers 46 pivotally mounted thereon. Only three pushers 46 are shown in FIG. 3 for the purposes of clarity, but the pushers 46 are spaced longitudinally all along the chains 24 at intervals of about 8 to 12 centimeters. Pushers 46 stand up to push a box through case sealer 10, but when they lie down they have downwardly depending legs 48 and 50 on either side of chains 24. When pushers 46 are lying down, the legs 50 normally travel along in respective grooves 40, and legs 48 normally travel over the top edge 51 which forms a sidewall of groove 42. However, when it is desired to have pushers 46 stand up to engage a box, a cam 52 is moved inwardly causing a tab 53 on leg 48 to engage cam 52 and move pusher 46 transversely or sideways. This causes leg 50 to move sideways and engage another cam 54, which is actually one of the side walls of groove 40. This causes the pusher 46 to tilt upwardly into an upright position so that it can engage a box to be pushed through case sealer 10. Tabs 53 ride along in groove 42 to keep pushers 46 upright.

Pushers 46 can either be biased by gravity to lie down or springs (not shown) could be used for this purpose. The pushers that were upright also move laterally under the force of springs 61, so that they will not pop upright unless they are forced to do so at the appropriate time by cam 52. When pushers 46 reach the ends of tracks 38, tabs 53 come out of grooves 42 and the pushers then lie down again until they come around by the return of chains 24 and again engage cams 52.

Figure 7:
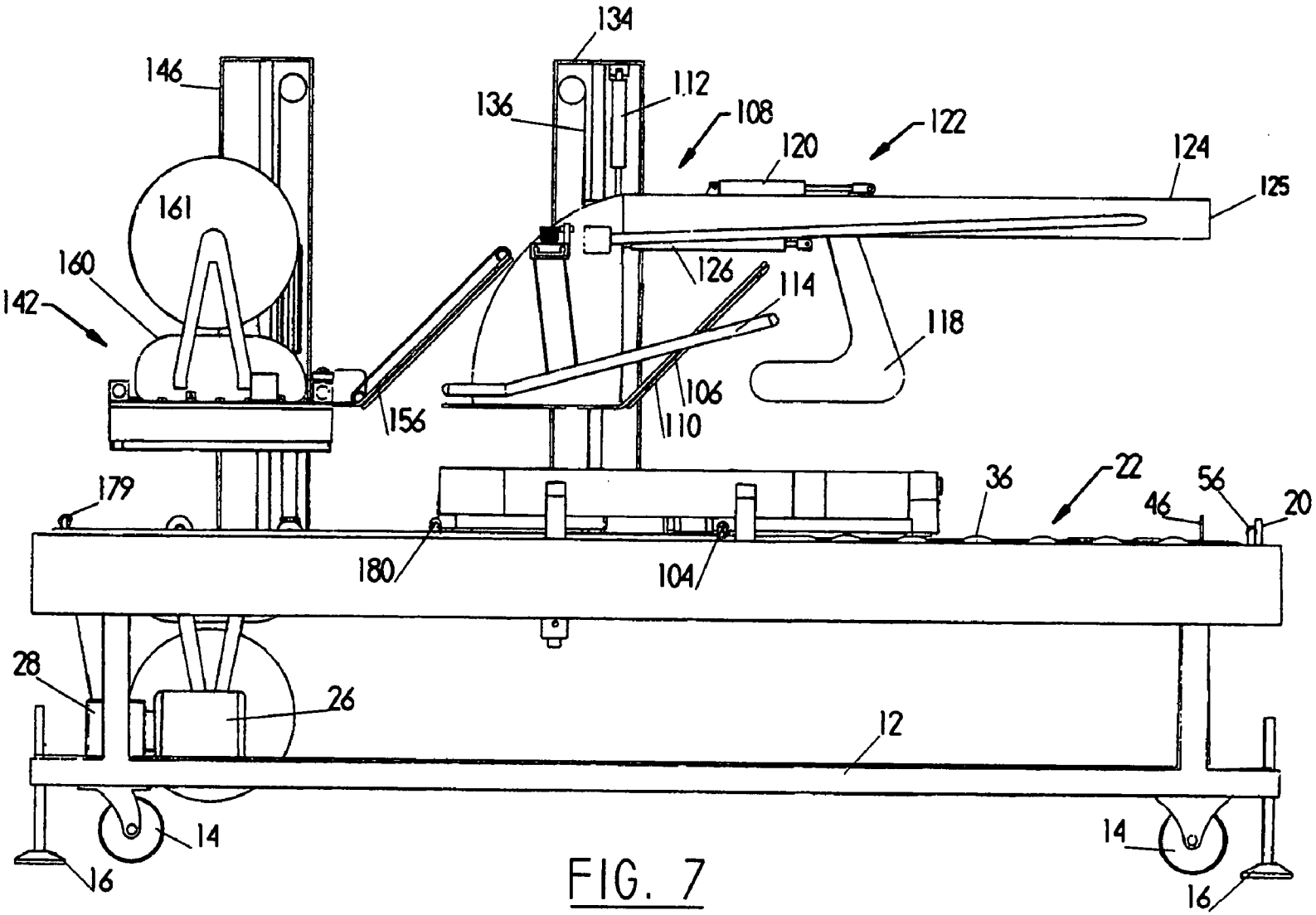
FIG. 7 is a side elevational view taken along lines 7-7 of FIG. 1.

Referring again to FIGS. 1 and 2, boxes that are ready to enter case sealer 10 are normally held back by the gate mechanism 20. When it is desired that the first box on a packaging line enter case sealer 10, gate mechanisms 20 are lowered (this is also the starting position when case sealer 10 starts up), and the packaging line conveyor feeds a box to case sealer 10 causing the first box to be picked up by entrance conveyor 22. Entrance conveyor 22 travels at a faster speed than the packaging line feeding box sealer 10, so a gap opens up between the box entering case sealer 10 and the box next behind it. When the box to be sealed fully enters entrance conveyor 22, a limit switch 56 (see FIG. 7) senses that the rear end of the box has passed that point and causes gate 20 to rise and hold back the next box to be sealed. Limit switch 56 also causes the pusher cam 52 to move over, which in turn causes a row of pushers 46 to pop up behind the box being sealed. The pushers 46 eventually catch up with the box to be sealed and push it into a pair of longitudinal, laterally spaced-apart, lateral conveyors 58 and 60, which receive the box from the entrance conveyor 22.

Figure 4:
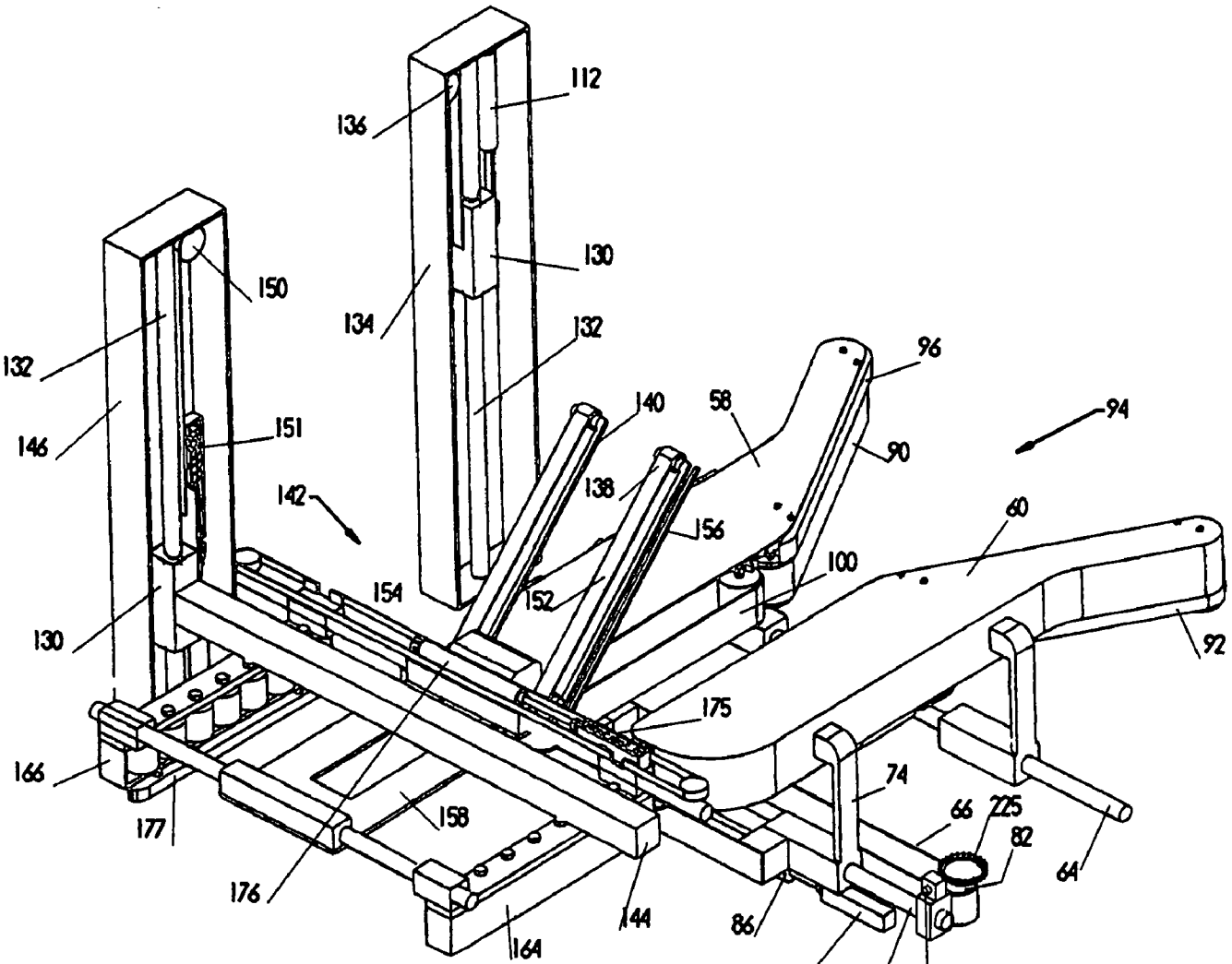
FIG. 4 is a perspective view taken from above and from the rear showing some of the components of the case sealer shown in FIGS. 1 and 2.
Figure 5:
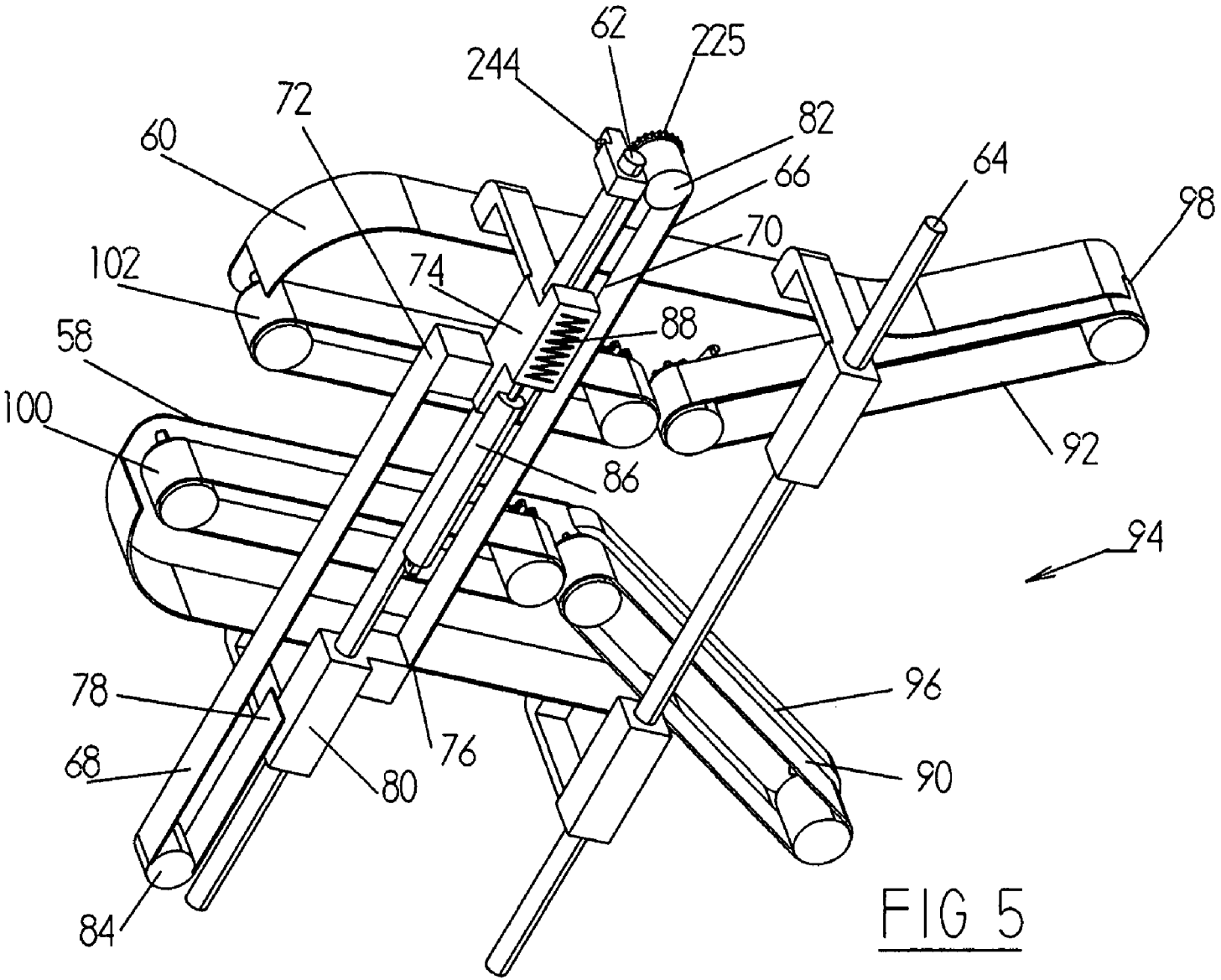
FIG. 5 is a perspective view taken from below of the lateral conveyors shown in FIGS. 1 and 2.

Referring next to FIGS. 4 and 5, lateral conveyors 58 and 60 are slidably mounted on transverse shafts 62 and 64 for inward and outward movement to adjust for the width of a box being sealed in case sealer 10. Lateral conveyors 58 and 60 are linked together for equal movement inwardly and outwardly to match the width of the box passing therethrough. The linking means includes a pair of belts 66 and 68 (see FIG. 5). Each belt has one respective end 70, 72 attached to a slide mount 74 which slidably mounts lateral conveyor 60 on shaft 62. Each of the belts 66 and 68 has a second opposed respective end 76, 78 attached to a second slide mount 80 which slidably mounts lateral conveyor 58 on shaft 62. Sheaves 82 and 84 are rotatably mounted in frame 12, so that belt 66 passes around sheave 82 and belt 68 passes around sheave 84, as a result, when slide mount 80 moves outwardly away from the longitudinal center line of case sealer 10, belt 66 causes slide mount 74 also to move outwardly away from the longitudinal center line of case sealer 10. Similarly, when slide mount 74 moves inwardly towards the center line of case sealer 10, belt 68 causes slide mount 74 to move inwardly towards the center line of the case sealer. Slide mount 74 is moved inwardly and outwardly by a pneumatic cylinder 86 mounted in frame 12 and acting through a spring mount 88 attached to slide mount 80. Spring mount 88 provides some flexibility for the relative positioning of lateral conveyors 58 and 60 to accommodate some non-uniformity in the width of the boxes being sealed in case sealer 10. The belts 66 and 68 pass around sheaves 82 and 84 in a U-shaped fashion. Chains and sprockets could be used in place of belts and sheaves. A single or continuous belt or chain could also be used, as long as it is attached to the two slide mounts 74, 80 as indicated. Other devices, such as racks and a pinion could also be used to link the lateral conveyors together, so that outward and inward movement of one lateral conveyor causes respective outward and inward movement of the other lateral conveyor.

Lateral conveyors 58 and 60 have diverging centering conveyor belts 90 and 92 forming a throat 94 to center a box therebetween. As seen best in FIG. 1, if a box travelling toward lateral conveyors 58 and 60 is off center, it will hit one of the centering conveyor belts 90 and 92 first, and this centering conveyor belt will move the box over toward the center.

Lateral conveyors 58 and 60 also have centering sensors 96 and 98 mounted just above their respective centering conveyor belts 90 and 92. Centering sensors 96 and 98 are pivotably mounted bars that actuate limit switches behind them. When a corner of the box hits one of the centering sensors 96 or 98, the sensor retracts closing its limit switch while still allowing the box to engage the respective centering conveyor belt 90 or 92. This causes the box to be moved over toward the center of the case sealer. When both the centering sensors 96 and 98 are engaged by the box, the box is centered. The respective limit switches in sensors 96 and 98 are connected in series and when both switches are closed, this causes a controller to actuate cylinder 86 and cause the lateral conveyors 58 and 60 to open up to accommodate the box. Cylinder 86 acts slowly enough to ensure that both corners of the advancing box remain in contact with centering conveyor belts 90 and 92 and the speed of centering conveyor belts 90 and 92 is higher than entrance conveyor 22 so that the boxes advance at the same speed as the pushers 46 are moving along entrance conveyor 22.

The box continues to advance until the leading vertical corners of the box engage a pair of parallel, first advancing conveyor belts 100 and 102 mounted in the respective lateral conveyors 58 and 60. As this happens, the box trips another limit switch 104 (see FIG. 7) causing the controller to close the control valve controlling cylinder 86 to lock the first advancing conveying belts 100 and 102 in engagement with the box therebetween. When this happens, the controller has sensed and knows the actual width of the box. The first advancing conveyor belts 100 and 102 then continue at the same speed as entrance conveyor 22 to move the box through case sealer 10 until the leading top flap of the box engages an upwardly inclined entry ramp 106 mounted in a first floating head 108 spaced above the lateral conveyors 58 and 60. In some embodiments, the entry ramp 106 is inclined about 45 degrees. Entry ramp 106 includes a sensor bar 110. When the top horizontal edge of the box hits sensor bar 110, this causes a controller to actuate another pneumatic cylinder 112 and raise floating head 108 upwardly at a speed such that top horizontal edge of the box remains in contact with entry ramp 106. As the top flap of the box is folded downwardly and the top of the box passes under sensor bar 110, its limit switch opens causing the control valve operating cylinder 112 to close locking the floating head 108 in position. In this way, if the box is over loaded or it is too high, it will contact the sensor bar 110 to activate the floating head 108 to raise it to the proper height. As the box advances further, upwardly and outwardly disposed side bars 114 and 116 engage the box side flaps and fold them inwardly.

Before the box side flaps are folded in, the rearward or trailing end flap of the box is folded downwardly by a pivot arm 118 actuated by another pneumatic cylinder 120. The pivot arm 118 may be activated by the limit switch 104. The pivot arm 118 and pneumatic cylinder 120 are part of a pivot arm assembly 122 slidably mounted in a boom 124 extending over the entrance conveyor 22 and having a distal end 125. The boom 124 is mounted in the first floating head 108. The pivot arm assembly 122 is moved along the boom 124 by another pneumatic cylinder 126 to accommodate and close the trailing end flaps of boxes of varying lengths up to about 1.5 to 2 meters or even longer simply by making boom 124 and entrance conveyor 122 longer, as required. Where such long boxes are sealed in case sealer 10, the position of the pivot arm assembly 122 and the activation of the pivot arm 118 is controlled by the limit switch 56 which senses when the rearward or trailing end wall of the box has entered the entrance conveyor 22 and passed the gate 20. It will be appreciated that the pneumatic cylinder 126 extends to move the pivot arm assembly 122 towards the end 125 of the boom 124 prior to a box being received between the lateral conveyors 58 and 60 and prior to the rearward end wall of the box entering the entrance conveyor 22, and retracts to move the pivot arm assembly 122 away from the end 125 of the boom 124 when the rearward end wall of the box has entered the entrance conveyor 22 and passed the gate 20. The pivot arm assembly 122 is retracted as the box passes through the lateral conveyors 58, 60 at a speed that is the same as a speed of the box moving through the case sealer.

For smaller boxes, the pivot arm assembly 122 may not extend towards the end of the boom 124. Depending on the size of the box and the retracted position of the pivot arm assembly 122, the pivot arm assembly 122 may remain in the retracted position where the rearward or trailing end flap of the box will be folded downwardly by the pivot arm 118 when actuated by the pneumatic cylinder 120. The box will then have its side flaps are folded inwardly by the side bars 114, 116.

Floating head 108 includes a transverse member 128 attached at its opposed distal ends to slides 130 mounted for vertical sliding movement on shafts 132 in towers 134. Cylinders 112 mounted in towers 134 are connected to slides 130 to move the floating head 108 up and down, as mentioned above. Towers 134 further include counterweight devices 136 attached to slides 130 to offset the weight of floating head 108. Counterweight devices 136 could be gravitational devices or coil spring type devices, as desired.

Figure 2:
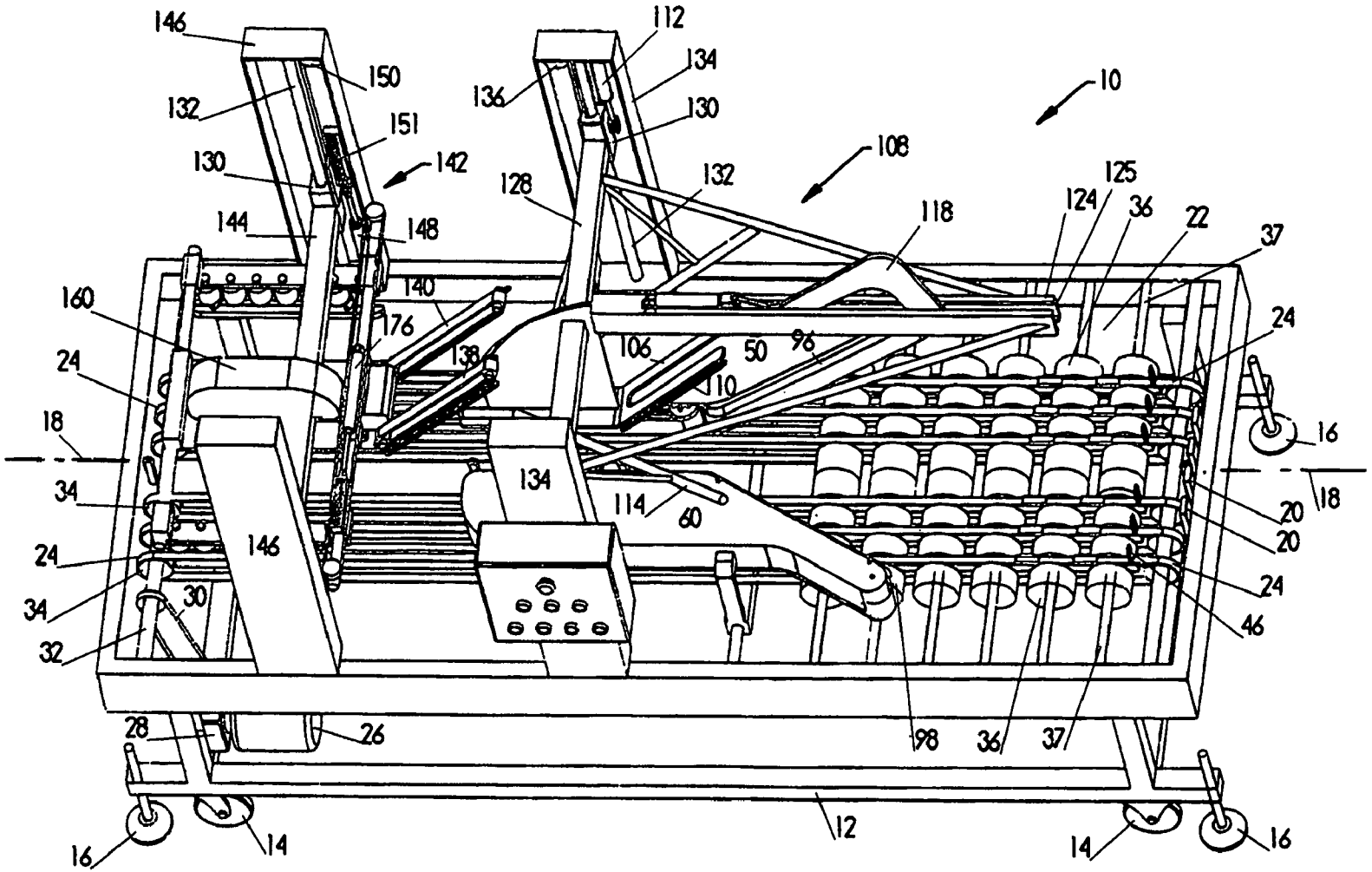
FIG. 2 is a perspective view similar to FIG. 1 but taken from a higher and more rearward angle and with some parts omitted for the purposes of clarity.
Figure 8:
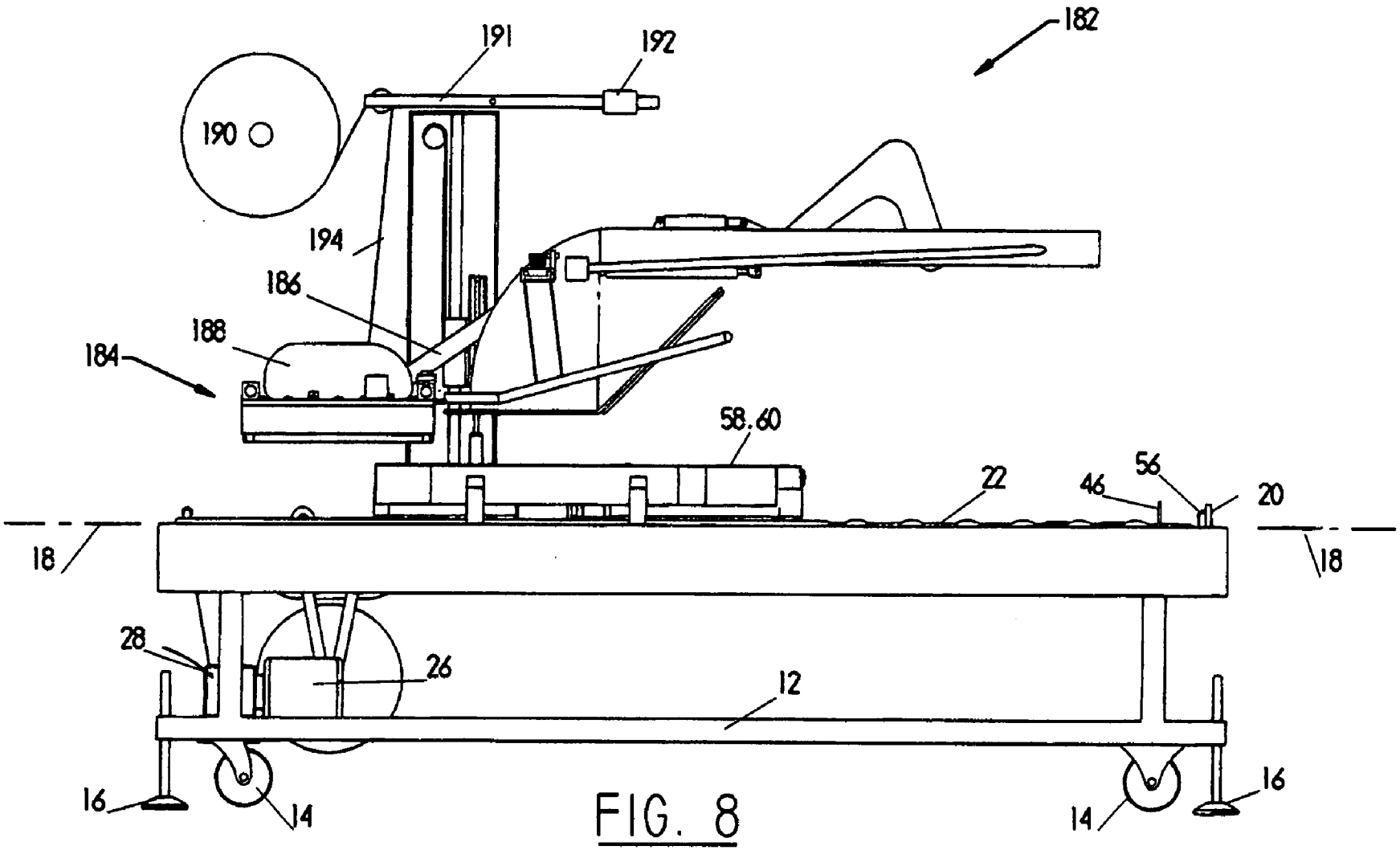
FIG. 8 is a side elevational view similar to FIG. 7 but showing a second embodiment of the present invention having only one floating head.
Figure 11:
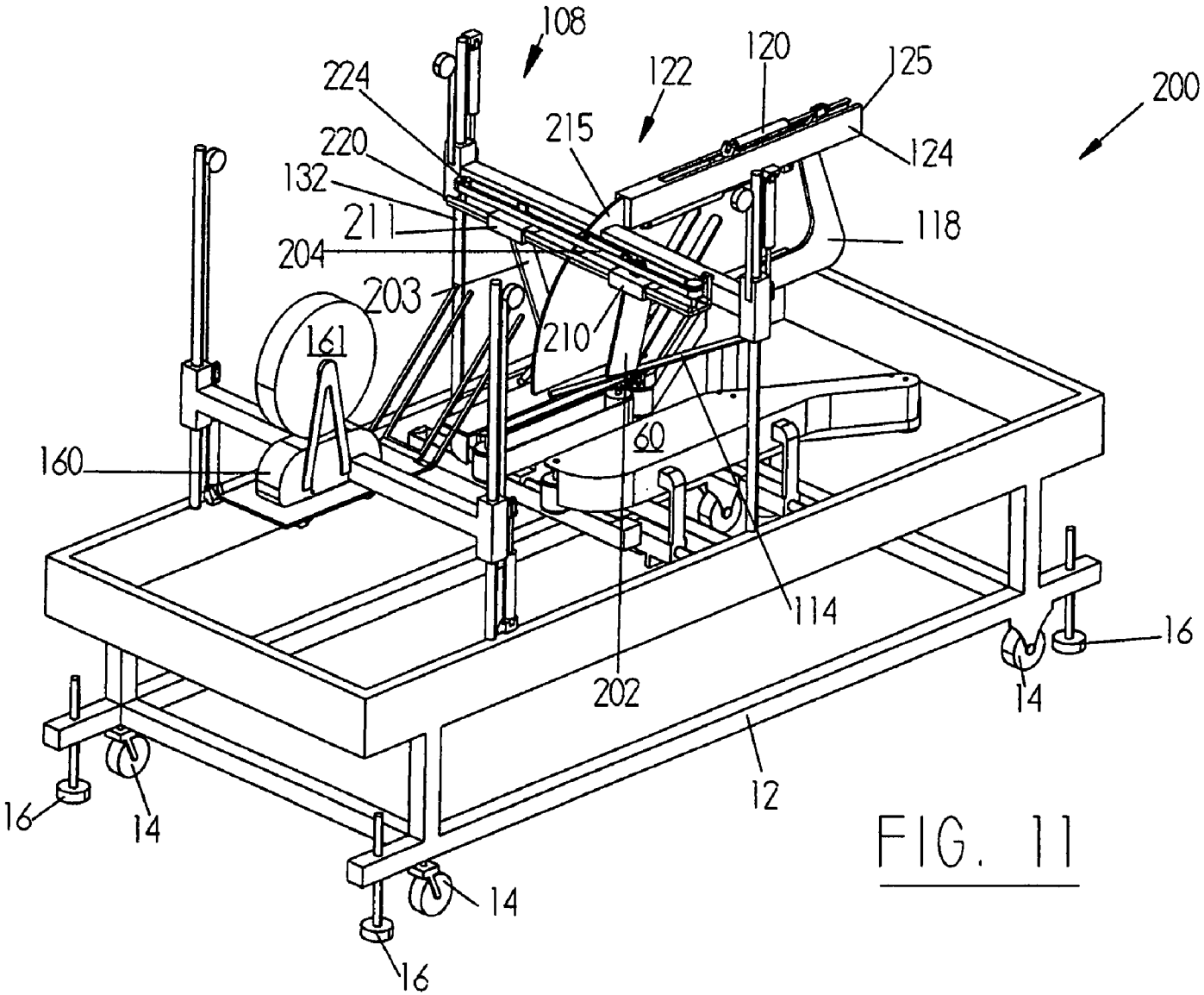
FIG. 11 is a perspective view taken from above and from the sealing end of a third embodiment of a case sealer according to the present invention.
Figure 12:
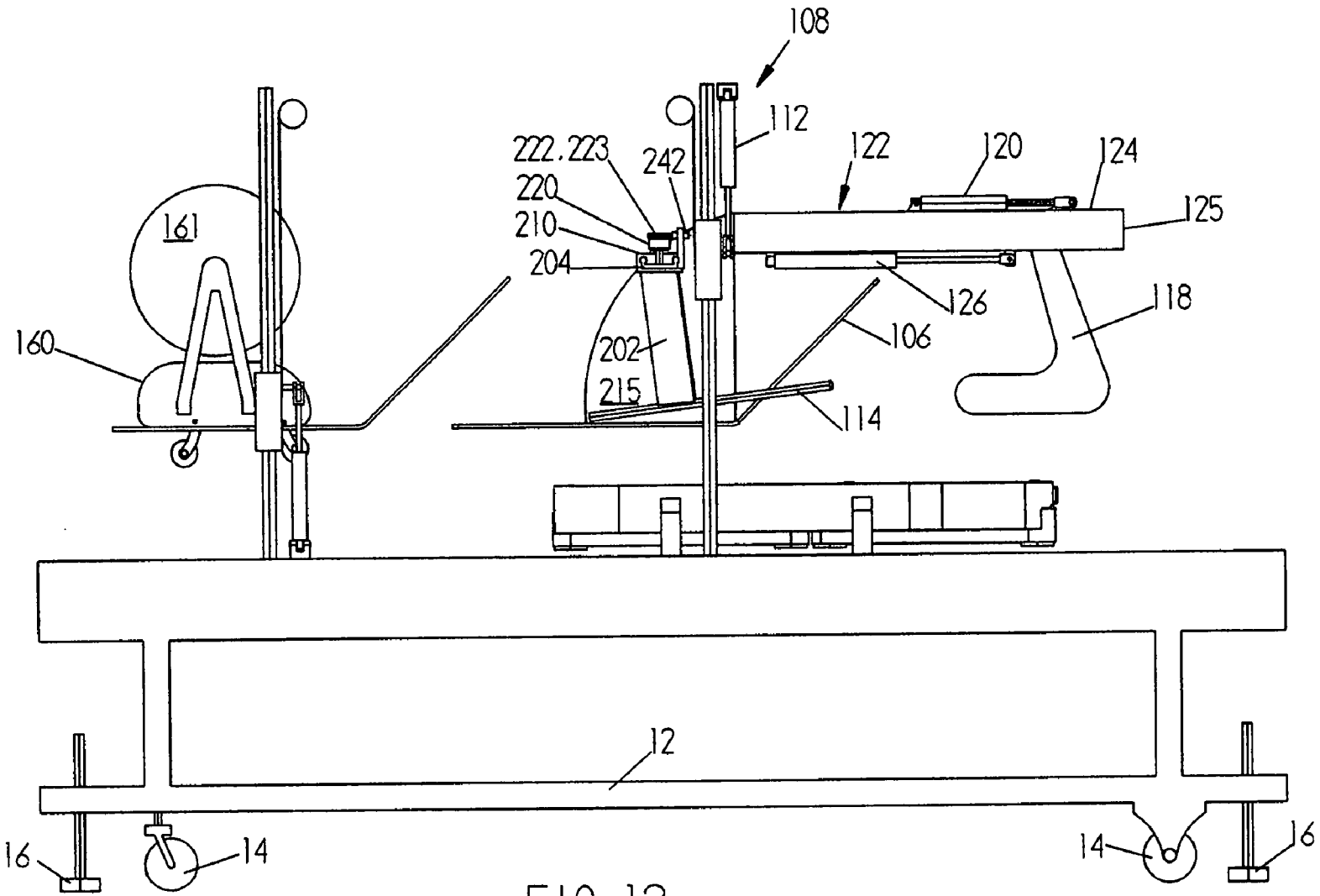
FIG. 12 is a side view of the case sealer shown in FIG. 11.

As the box passes out through the lateral conveyors 58, 60 and while the box top flaps are still being held down by floating head 108, the top, leading horizontal edge of the box engages a pair of entry ramps 138 and 140 mounted in a second floating head 142. Entry ramps 138 and 140 are also inclined like the entry ramp 106 (for example, at an angle of about 45 degrees). Floating head 142 is similar to floating head 108 in that it has a transverse member 144 having opposed ends attached to slides 130 slidably mounted on shafts 132 in towers 146 with pneumatic cylinders 148 to move the floating head up and down and counterweight devices 150 to offset the weight of the floating head 142. Cylinders 148 are attached to slides 130 through spring mounts 151 to provide some flexibility for the relative positioning of floating head 142 and to accommodate some non-uniformity in the height of the boxes (up to 10 centimeters) such as may be caused by overfilling, for example. Entry ramps 138 and 140 themselves have conveyor belts 152 and 154 mounted thereon, and one of the entry ramps includes a sensor bar 156 which operates a limit switch connected to cylinder 148 through an appropriate controller and actuator valve device to raise second floating head 142 at a speed to maintain the box in contact with entry ramps 138, 140. When the floating head 142 is raised sufficiently to allow the box to pass under ramps 138, 140, the sensor bar 156 stops the vertical movement of the second floating head 142 and the box passes under a seal dispensing platform 158. Again, this allows over filled boxes to be accommodated as described above. Seal dispensing platform 158 is located downstream of the first advancing conveyor belts 100, 102 of the first floating head 108, and the seal dispensing platform 158 is means for holding the box flaps shut until they are sealed by a sealing device such a tape machine or dispenser 160 mounted on seal dispenser platform 158. FIG. 1 shows a taping machine 160 where the tape supply 161 is mounted on the taping head. However, it is preferable to have the tape supply mounted separately on frame 12, as shown in FIG. 8. In any event, any type of tape dispenser 160 could be used in the subject invention.

Figure 6:
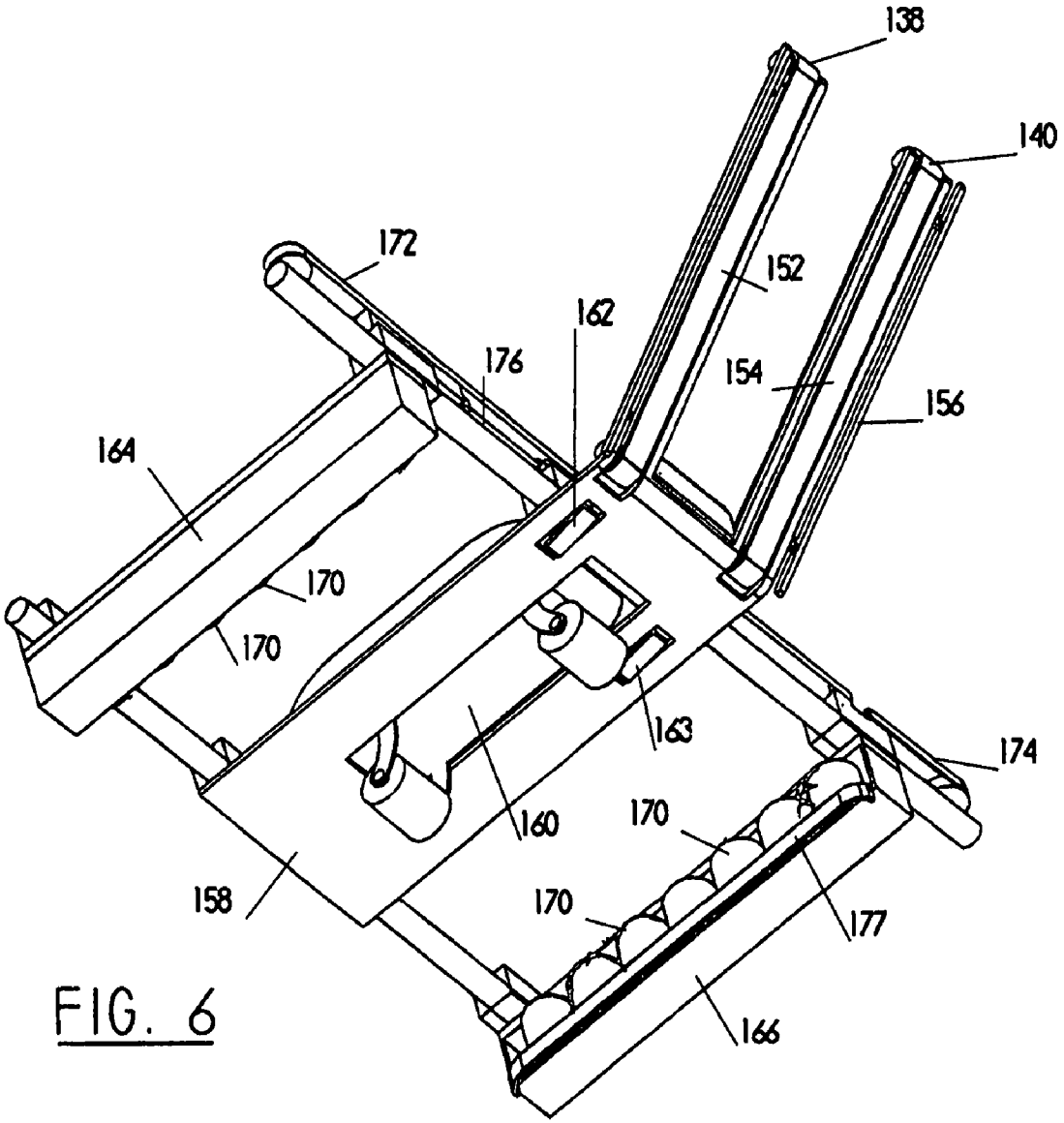
FIG. 6 is a perspective view taken from below of the tape dispensing platform shown in FIGS. 1 and 2.

As the box passes under seal dispensing platform 158, it engages another limit switch 162 which causes seal dispensing platform 158 to move downwardly to apply pressure to the top of the box and also cause the spaced-apart, parallel, second advancing conveyors 164 and 166 to move inwardly to engage the sides of the box. Conveyors 164 and 166 preferably are formed of free wheeling rollers 170 as indicated in FIG. 6. Further advance of the box causes it to hit another limit switch 163 to lock seal dispensing platform 158 in position.

Second advancing conveyors 164, 166 are linked together by linking belts 172, 174 (see FIG. 6) in a manner similar to the belts 66 and 68 of the lateral conveyors 58 and 60. In this way, the second advancing conveyors 164 and 166 move inwardly and outwardly simultaneously using only one actuating cylinder 176 acting through a spring mount 175. One of the second advancing conveyors 164, 166 has a sensor bar 177 to sense when the sides of the box are engaged by conveyors 164 and 166, control the pressure of conveyors 164 and 166 on the box, and lock conveyors 164 and 166 in position. When the box passes the second floating head 142 and tape dispenser 160, sensor 179 (see FIG. 7) senses this and allows conveyors 164 and 166 to open again and floating head 142 to rise to be ready for the next box to be sealed.

In the operation of case sealer 10, the case sealer can be made to operate in several different modes as selected by a control box 178. Where the boxes are all of the same height, width and length, the gate mechanism 20 can be opened at regular intervals almost as soon as the rear wall of a box ahead passes limit switch 56. In the shown embodiment, the gate mechanism 20 provides a gap or spacing between the boxes of about 25 to 35 centimeters. For most applications, this gap is sufficient for the pivot arm 118 to move up and down and close the end flaps of the next box. In this operational mode, the lateral conveyors 58 and 60 remain in the same position between boxes because the boxes are all of the same size. A box can go on to be sealed by the floating sealing head 142 while another box enters the lateral conveyors 58 and 60 to have its flaps folded down by the floating head 108.

In operational modes where the height and length of the boxes being sealed are the same but the width changes, the lateral conveyors 58 and 60 may be returned to a starting or home position between boxes. The speed of entrance conveyor 22 and lateral conveyors 58 and 60 is such that a box will clear the lateral conveyors 58 and 60 before the next box engages the centering conveyor belts 90 and 92, allowing the lateral conveyors 58 and 60 to return to the starting position between boxes. Lateral conveyors 58 and 60 return inwardly to their starting position when a limit switch 180 (see FIG. 7) senses that the box between them has cleared the lateral conveyors 58 and 60. Alternatively, the lateral conveyors 58 and 60 may await positioning information regarding the width of the next box rather then returning to the starting position.

In another mode of operation where the height and width of the boxes are the same but the lengths of the boxes vary (for example, up to about 64" in length), the cylinder 126 moves the pivot arm assembly 122 towards the end of boom 124, and when the rearward end of the box is sensed passing the limit switch 56, the pivot arm 118 comes down to close the rearward flap of the box and the cylinder 126 retracts the pivot arm assembly 122, so that pivot arm 118 travels along at the same speed as the box. Limit switch 56 also causes the pushers 46 to pop up behind the box, as mentioned above.

In a further mode of operation, where the boxes vary in length, width and height between about 15 and 60 centimeters, the pivot arm assembly 122 stays in its inward or retracted position, but the gate mechanism 20 is not lowered to let the next box enter the case sealer until the previous box has passed limit switch 104. Limit switch 104 can also be used to activate pivot arm 118. This allows the first floating head station and lateral conveyors 58 and 60 to be reset to accept the next randomly sized box.

In yet another mode of operation, where the boxes vary in width and height, and also in length between about 60 centimeters and about 1.5 meters, the pivot arm assembly 122 extends to the outer end of boom 124 when the rear of the box passes the limit switch 56. The pivot arm 118 comes down to close the rearward flap of the box, and the pivot arm assembly 122 retracts with the box as in the second mode above.

Referring next to FIG. 8, another embodiment of a case sealer 182 is shown. The same reference numerals have been used in FIG. 8 to indicate components that are essentially the same as those of the embodiments shown in FIGS. 1-7. In the FIG. 8 embodiment, the second floating head has been eliminated and the seal dispensing platform 184 that corresponds to FIG. 6 has been attached to the first floating head 108 by attachment members 186. Case sealer 182 is also shown having a preferred type of taping machine 188 where the supply of tape 190 is located above the seal dispensing platform 184. A pivoting tension bar 191 with an adjustable counterweight 192 maintains tension in the tape 194 even though the tape machine 188 is moving up and down. Case sealer 182 works in a manner similar to case sealer 10 but the box being sealed has to clear the seal dispensing platform 184 before the lateral conveyors 58 and 60 can be reset to accept the next box to be sealed.

Referring next to FIG. 11 to 16, another embodiment of a case sealer 200 is shown. In this embodiment, the upwardly and outwardly disposed side bars 114 and 116 are moveable to provide movable side flap closers to accommodate and close the side flaps of boxes of varying width. The case sealer 200 is otherwise generally similar to the case sealer 10 described above. The same reference numerals have been used in FIG. 11 to 16 to indicate components that are essentially the same as those of the embodiments shown in FIGS. 1-10. Some of the components of the case sealer 200 have not been shown for the purposes of clarity.

The side bars 114 and 116 are each located at an angle relative to the longitudinal axis 18 of the frame 12 that forms an angle of attack relative to a box moving through the case sealer 200. The side bars 114 and 116 are positioned in a diverging position relative to each other for engaging and folding inwardly side flaps on the box after the rearward end flap has been folded inwardly. The side bars 114 and 116 are attached to respective lower arms 202 and 203 slideably mounted to and extending downwardly from a transverse member 204. The transverse member 204 has opposite first and second ends 230 and 232, and extends transverse to the longitudinal axis 18 of the frame 12.

The transverse member 204 includes one or more guide rails or tracks 206. In the shown embodiment, the transverse member 204 includes a pair of tracks 206 along peripheral side edges 208 of the transverse member 204. The lower arms 202 and 203 are slideably mounted to the transverse member 204 using slide mounts 210 and 211 positioned towards the first and second ends 230 and 232 respectively. The slide mounts 210 and 211 each define a pair of longitudinal channels or grooves (not shown) extending longitudinally along the length of the slide mounts 210, 211. The grooves are positioned to correspond to the location of the tracks 206 and correspond in shape to the tracks 206 of the transverse member 204. Where only one track 206 is provided by the transverse member 204, the slide mounts 210 and 211 include only one groove.

A pneumatic cylinder 212 is operatively connected between one of the slide mounts 210 or 211 and the first floating head 108 allowing the cylinder 212 to extend and retract along an axis transverse to the longitudinal axis 18 of the frame 12. As seen best in FIGS. 14 and 16, the pneumatic cylinder 212 is operatively connected between a tab 214 on an upper surface of the slide mount 210 positioned towards the first end 230 of the transverse member 204 and a fixed vane 215 (see FIG. 13) mounted in floating head 108. In other embodiments, the pneumatic cylinder 212 may be connected to other fixed components of the floating head 108 such as, for example, the transverse members 128 of the first floating head 108 or the boom 124. In the shown embodiment, the extending end of the cylinder 212 is mounted to the slide mount 210 and the opposite fixed end of the cylinder 212 is connected to the first floating head 108.

Figure 13:
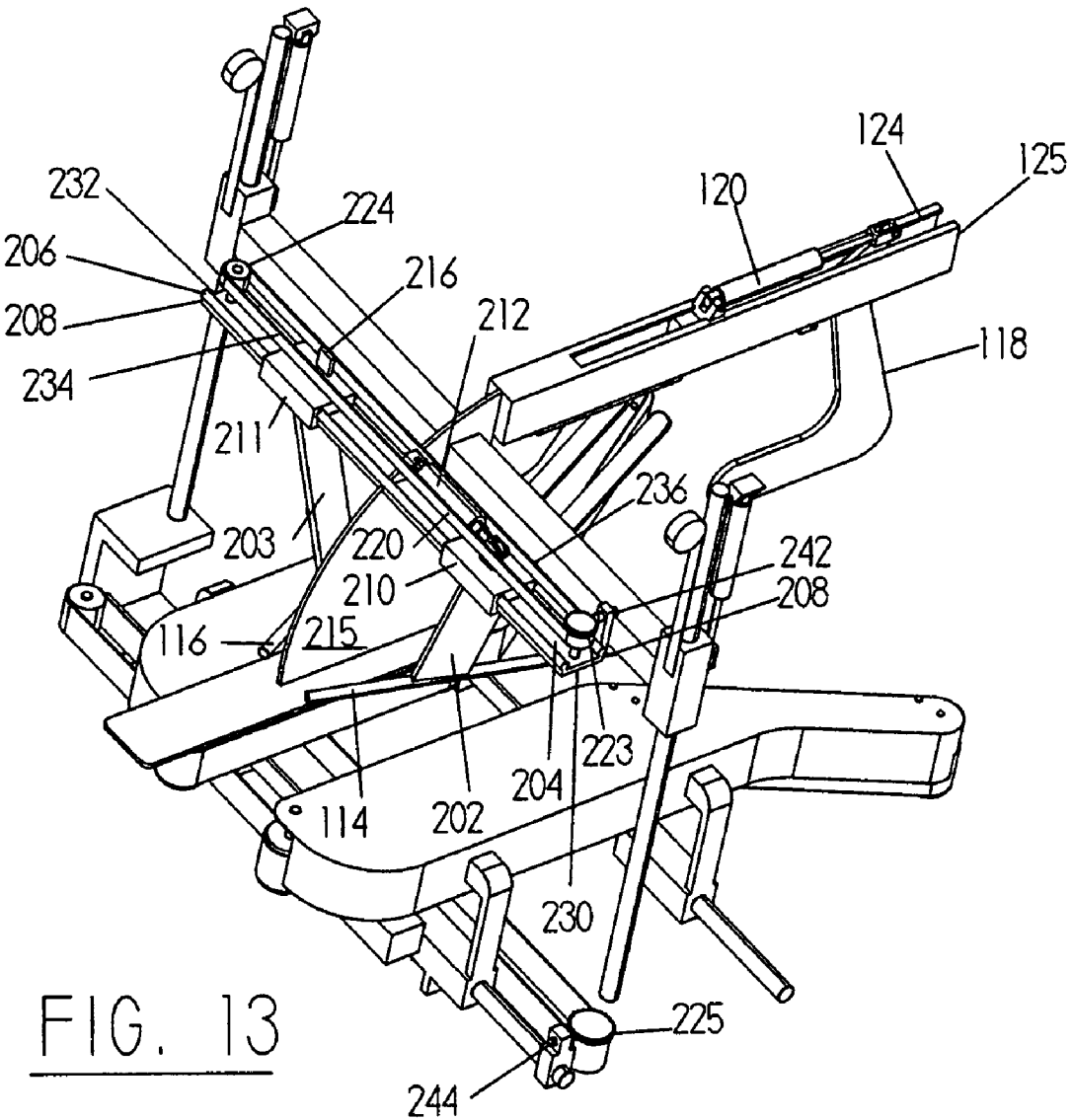
FIG. 13 is an enlarged perspective view showing a portion of the case sealer shown in FIGS. 11 and 12.
Figure 14:
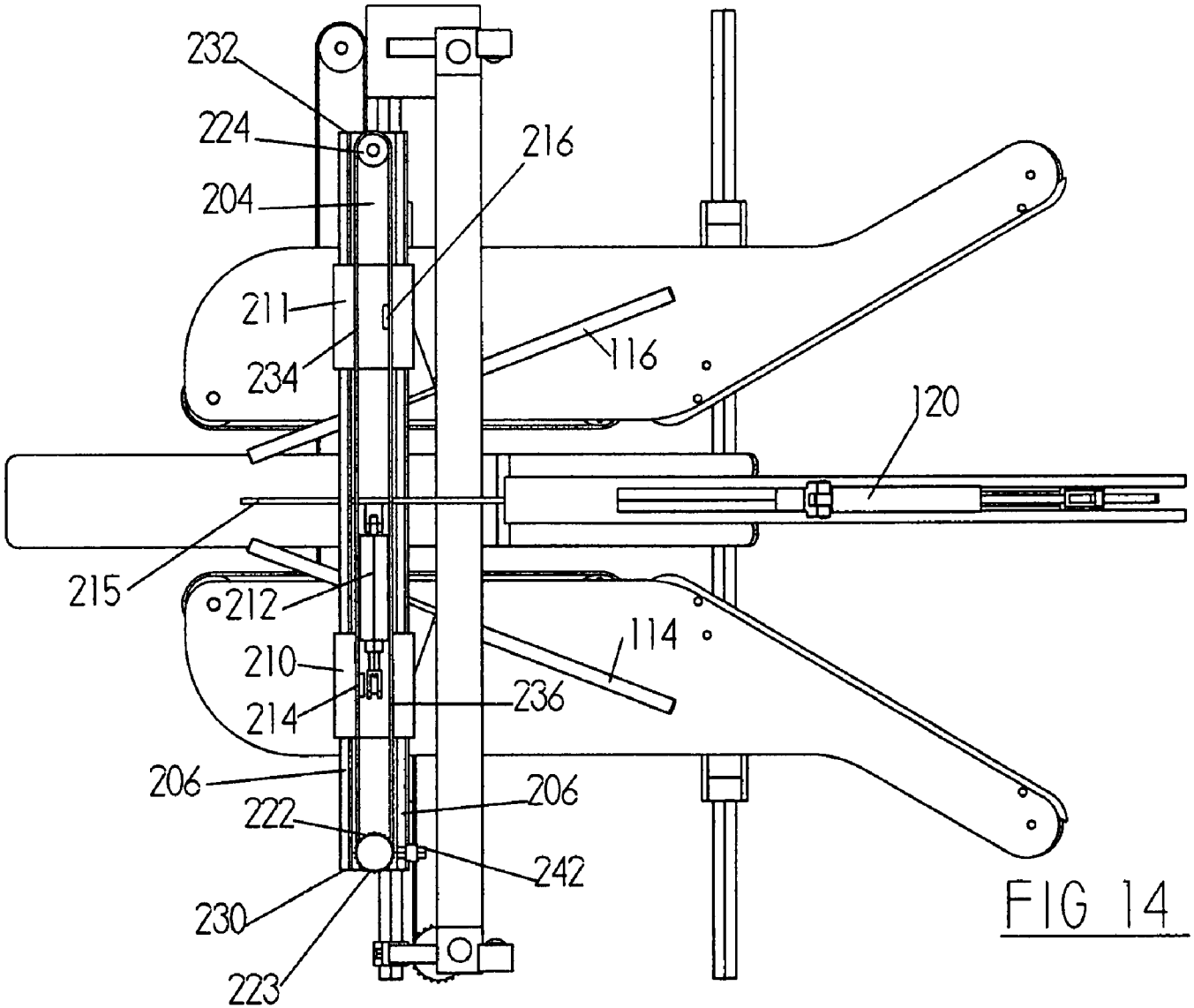
FIG. 14 is a top view showing a portion of the case sealer shown in FIGS. 11 and 12.
Figure 15:
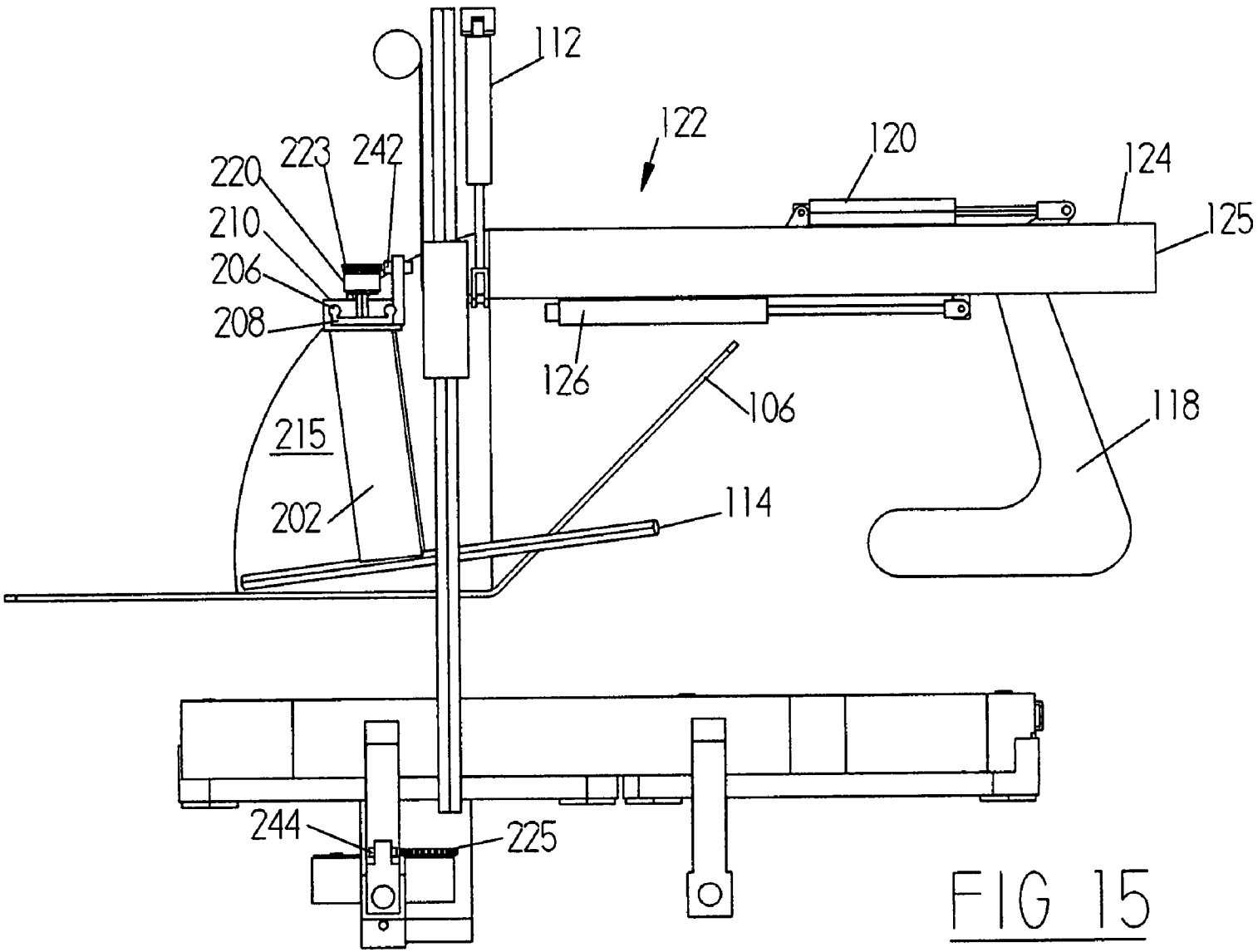
FIG. 15 is a side view showing a portion of the case sealer shown in FIGS. 11 and 12.

As shown in FIG. 13-15, a sensor 244 is mounted opposite the lateral conveyors 58, 60 to determine the position of the lateral conveyors 58, 60 and/or the width of the box being processed by the case sealer 200. In the shown embodiment, a sprocket 225 is mounted to the sheave 82 on the lateral conveyor 60. The sensor 244 counts teeth on the sprocket 225 as it rotates to determine the position of the lateral conveyors 58, 60 and the width of the box being sealed. The sensor 244 sends this information to a logic controller (not shown) for controlling the movement and position of the side bars 114 and 116. This controller controls the inward and outward movement of the side bars 114, 116.

Figure 16:
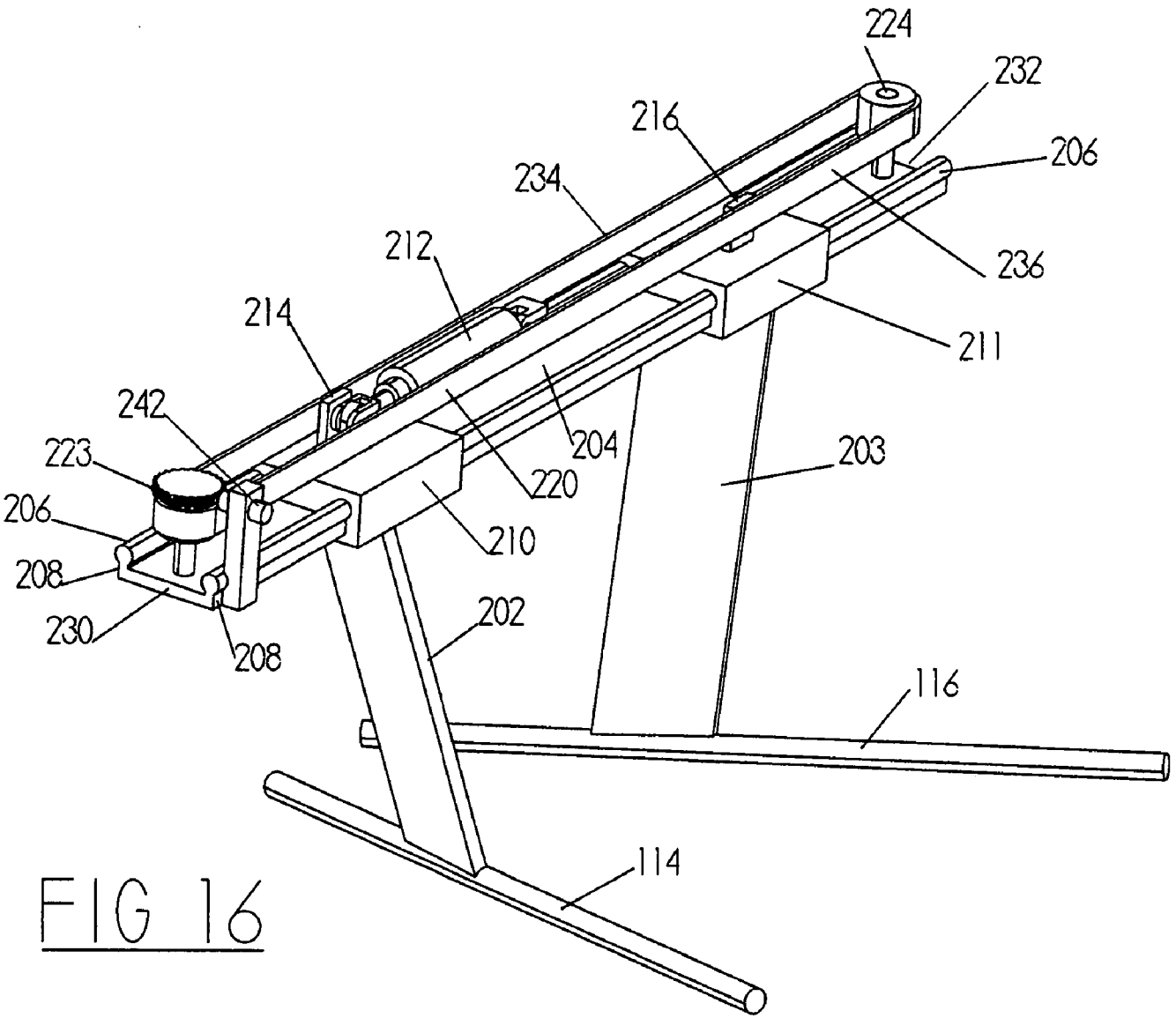
FIG. 16 is an enlarged perspective view showing the side bars of the case sealer shown in FIGS. 11 and 12.

A belt 220 extends about sheaves or rollers 222 and 224 positioned towards the first and second ends 230 and 232 of the transverse member 204 respectively. Roller 222 has a sprocket 223 mounted on it. The belt 220 has first and second sides 234 and 236 forming a pair of opposed runs. As best seen in FIG. 16, the belt 220 is fixed on its first side 234 to the tab 214 on the upper surface of the slide mount 210,-and is fixed on its second side 236 to a tab 216 on the upper surface of the slide mount 211. The belt 220 is formed of a relatively rigid or inelastic material.

The pneumatic cylinder 212 is connected to the controller for controlling the movement and position of the side bars 114 and 116. The required position of the side bars 114 and 116 is determined using information about the width of the box obtained from the sensor 244. The controller may then move the side bars 114 and 116 to the proper position for the box being processed. The controller activates or extends the cylinder 212 and deactivates or retracts the cylinder 212 based on the box width information from the sensor 244.

A sensor 242 counts teeth on the sprocket 223 as it rotates to determine the position of the side bars 114 and 116. The sensor 242 sends this information to the controller for controlling the movement and position of the side bars 114, 116 to provide positioning information about the position and space between the side bars 114, 116. In this way, the controller can determine if the side bars 114 and 116 need to be moved (i.e. if the boxes are of varying width), and if so, the amount by which the side bars 114 and 116 need to be moved either inwardly or outwardly. Because the controller controls where the side bars 114, 116 are located, if the next box to be sealed is bigger or smaller based on the width information of the box provided by the sensor 244, the controller can either instruct the cylinder 212 to remain in its current position because the next box is the same width, or move inwardly or outwardly to fit the width of the box.

During operation, the controller for the pneumatic cylinder 212 determines the position of the side bars 114 and 116, and based on the width of the box as previously determined, the cylinder 212 extends or retracts as necessary. As the cylinder 212 extends, the slide mount 210 moves outwardly away from the longitudinal axis 18 of the frame and the center of the floating head 108. The outward movement of the slide mount 210 pull on side 234 of the belt 220, which in turn pulls the slide mount 211 outwardly, because slide 234 is attached to slide mount 211 at tab 216. Similarly, retraction of cylinder 212 causes slide mount 210 to pull on side 236 of belt 220, which in turn moves slide mount 211 inwardly because belt side 236 is attached thereto at tab 216. Movement of the slide mounts 210 and 211 in this manner links together the movement of the side bars 114 and 116 for equal inward and outward movement to match the width of a box passing therethrough.

The side bars 114 and 116 are moveable between fully extended and fully retracted positions corresponding to fully extended and fully retracted positions of the pneumatic cylinder 212. However, it will be appreciated that there exists a range of positions between the fully extended and fully retracted positions that may be used to accommodate boxes of various widths.

It will be appreciated that the side bar linking means is similar to that described above for the lateral conveyors 58, 60 of the case sealer 10. The linking means is used to slide the side bars 114 and 116 along the transverse member 204 to accommodate and close the side flaps of boxes of varying width.

After a box has passed through the first floating head 108, the side bars 114 and 116 may return to a home position, for example to a fully extended or retracted position of the pneumatic cylinder 212, or the side bars 114 and 116 may wait for the positioning information for the next box to be processed by the case sealer 200.

In addition to allowing the case sealer 200 to accommodate and close the side flaps of boxes of varying width, the provision of moveable side flap closers allows a smaller angle of attack than is otherwise possible, reducing resistance to the movement of a box through the case sealer 200 which, in some embodiments, reduces the likelihood of the box becoming jammed against the side bars 114 and 116.

Referring now to FIG. 17 to 21, an alternate embodiment of a side flap closer for a case sealer is shown. In this embodiment, the upwardly and outwardly disposed side bars 114 and 116 are pivotably mounted to the slide mounts 210 and 211 respectively, to allow adjustment of the angle between the side bars 114 and 116 and the angle of attack in relation to boxes being processed by the case sealer. The same reference numerals have been used in FIG. 17 to 21 to indicate components that are essentially the same as those of the embodiments shown in FIGS. 1-16. Diverging outer portions of the side bars 114 and 116 are indicated by the references 251 and 253 respectively.

The lower arms 202 and 203 are rotably mounted to the transverse member 204 about vertically extending shafts 252 and 254. Extensible cylinders 256 and 258, such as pneumatic cylinders, are operatively connected between an upper portion of the lower arms 202 and 203 and the respective slide mounts 210 and 211. In the shown embodiment, the cylinders 256 and 258 are mounted between a side portion of the side mounts 210 and 211 and top plates 260 of the lower arms 202, 203. The top plates 260 extend beyond the side portion of the slide mounts 210 and 211 for mounting to the cylinders, and are positioned against the bottom the side mounts 210, 211.

Figure 17:
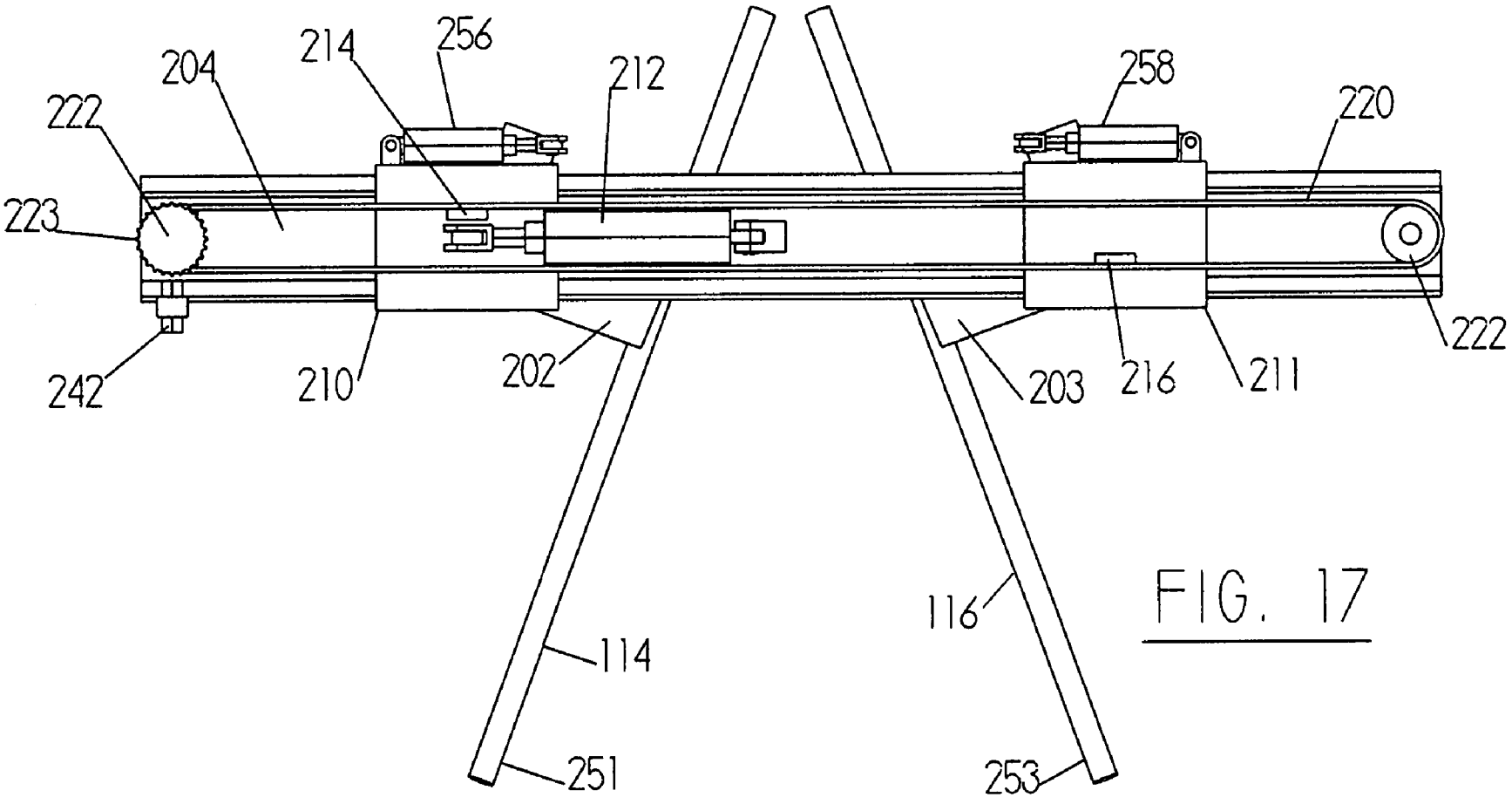
FIG. 17 is a top view showing an alternate embodiment of a side flap closer for a case sealer according to the present invention.
Figure 18:
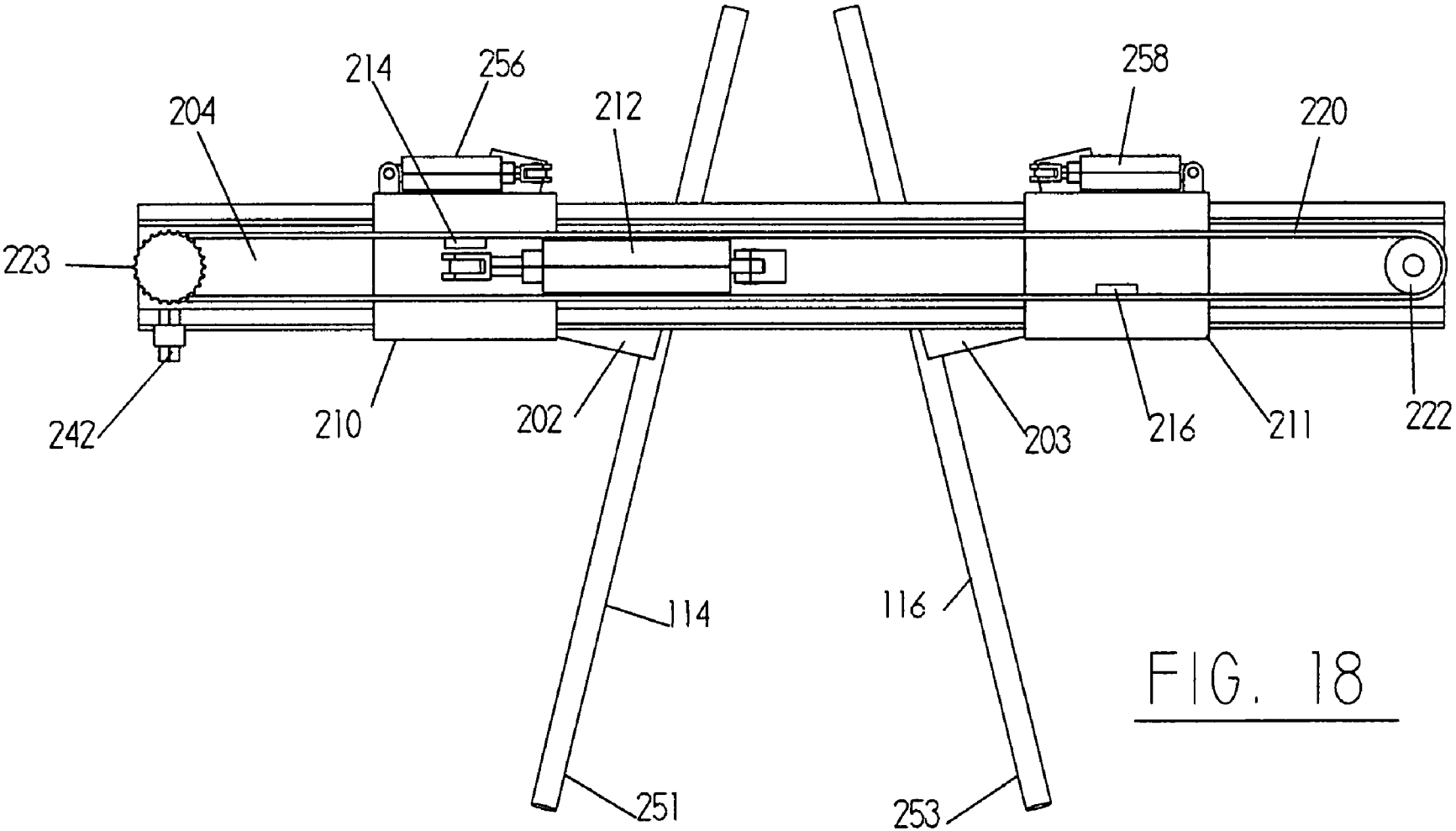
FIG. 18 is a top view of the side flap closer of FIG. 17 having the side bars angled closer together for a smaller angle of attack.
Figure 19:
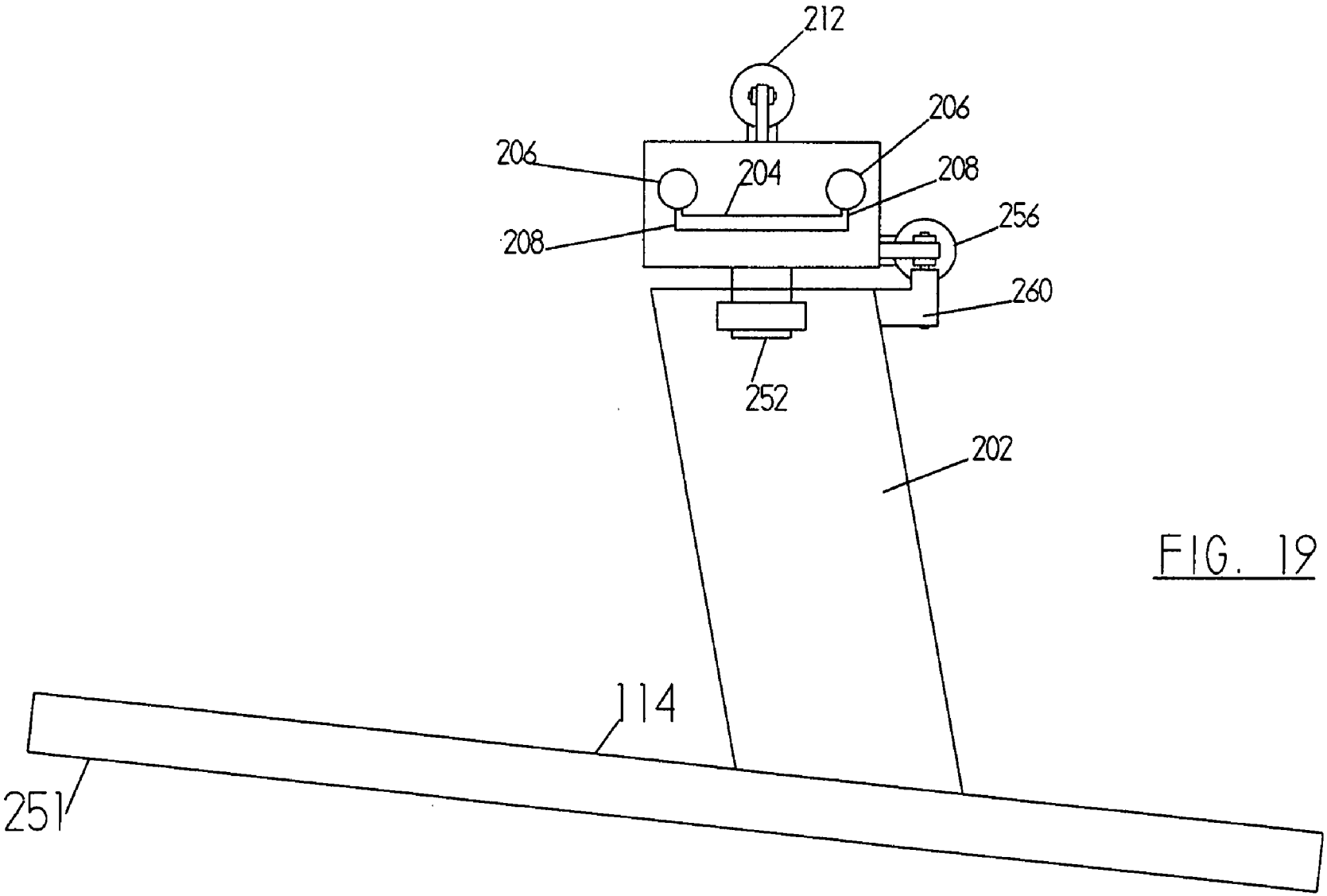
FIG. 19 is a side view of the side flap closer of FIG. 17 taking along the end a slide mount.
Figure 20:
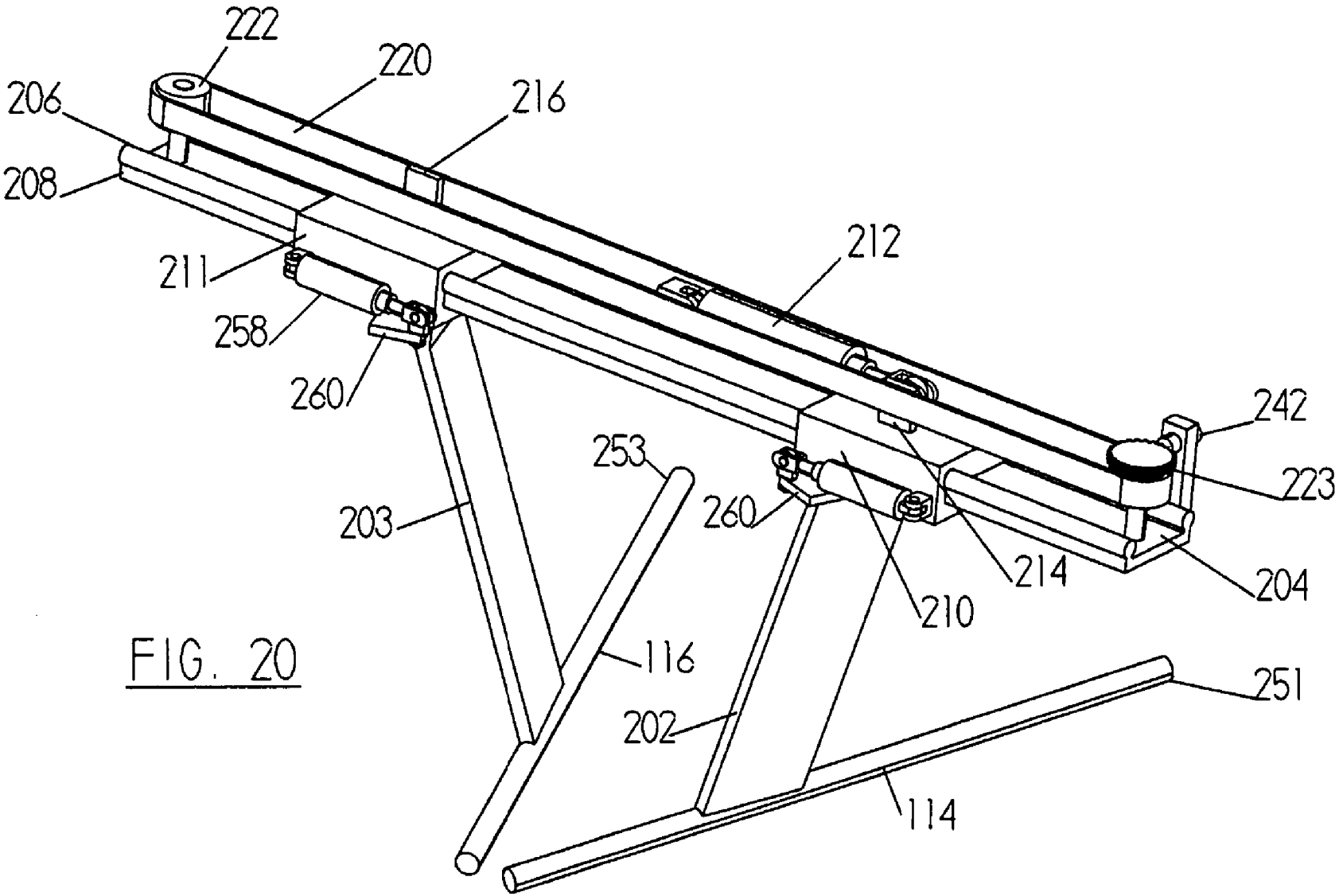
FIG. 20 is a perspective view taken from above showing the side bar closer of FIG. 17.
Figure 21:
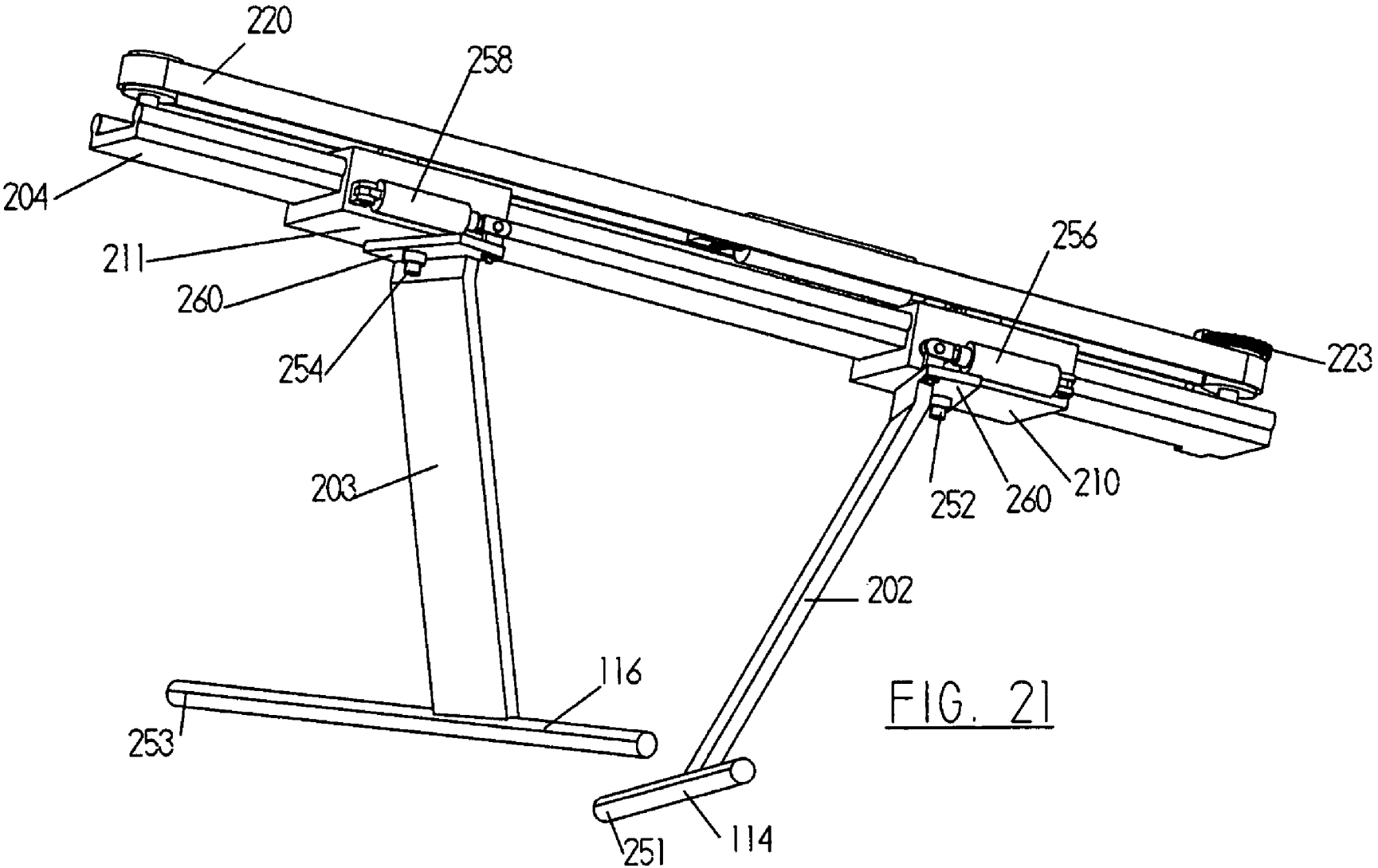
FIG. 21 is a perspective view taken from below showing the side bar closer of FIG. 17.

The cylinders 256, 258 extend and retract along an axis that is generally parallel to the transverse member 204 and generally perpendicular to the shafts 252 and 254. Extension and retraction of the cylinders 256, 258 pivots the lower arms 202 and 203 about the shafts 252 and 254, thereby pivoting the side bars 114 and 116. The cylinders 256, 258 are moveable between a retracted or home position as shown in FIG. 18, and an extended position as shown in FIG. 17. In one example embodiment, the side bars 114 and 116 are positioned at angle of about 40° relative to each other when in the retracted position of the cylinders 256, 258, and at an angle of about 15° relative to each other when in the extended position of the cylinders 256, 258.

As shown in FIG. 17, when the cylinders 256, 258 are extended, the side bars 114, 116 are pivoted outwardly and diverging portions 251, 253 swung outwards to increase the angle between the side bars 114 and 116, thereby increasing the angle of attack in relation to a box being sealed (for example for weaker box strengths). As shown in FIG. 18, when the cylinders 256, 258 are retracted, the side bars 114, 116 are pivoted inwardly and diverging portions 251, 253 swung inwards to decrease the angle between the side bars 114 and 116, thereby decreasing the angle of attack in relation to a box being sealed (for example for stronger box strengths). It will be appreciated by persons skilled in the art that this configuration may be modified so that retraction and extension of the cylinders 256, 258 has the reverse effect of that described above.

The cylinders 256, 258 are connected to a controller (not shown) such as a logic controller for pivoting the side bars 114 and 116 inwardly and outwardly. This controller is the same as the controller for moving the side bars 114, 116 inwardly and outwardly described above. The side bars 114 and 116 are moved together by activating (extending) and deactivating (retracting) the cylinders 256, 258 at the same time. An operator or technician may set the controller to pivot the side bars 114, 116 when the boxes being processed by the case sealer are medium or high strength (construction) boxes, and set the controller not to pivot the side bars 114 and 116 when the boxes being processed are low strength boxes. The control box 178 may be configured such that an operator need only set the type of box to be sealed and the controller will determine whether the side bars 114, 116 will be pivoted.

In this exemplary embodiment, there are two primary modes of operation of the side flap closer. In the first mode of operation, when medium, high strength or double wall boxes are processed, the side bars 114 and 116 are moved inwardly/outwardly according to the width of the box as described above. If the boxes being sealed are of the same width, the side bars 114, 116 may remain in position. When the front edge of the box is between or contacts the side bars 114, 116 and/or limit switch 104, the side bars 114, 116 are pivoted inwardly and diverging portions 251, 253 are swung inwards to decrease the angle between the side bars 114 and 116, thereby decreasing the angle of attack in relation to a box being sealed.

In an alterative mode of operation, the side bars 114, 116 are pivoted inwardly prior to moving the side bars 114, 116 inwardly/outwardly to match the width of the box.

In the second mode of operation, when low strength boxes are processed, the side bars 114, 116 are moved inwardly/outwardly to match the width of the box as described above, however the side bars 114 and 116 are not pivoted.

As with moving the side bars inwardly/outwardly, pivoting the side bars inwardly/outwardly to reduce the angle of attack of a box passing through the case sealer may be used to reduce the impact between the box side flaps and the side flap closing bars. As will be appreciated by persons skilled in the art, in the described embodiments a box passing through the case sealer is in constant motion. The box need not be stopped to close the end and side flaps of the box, rather the box is in motion as its end and side flaps are closed prior to having its flaps sealed. The side bars move inwardly and outwardly to match the width of the box as it moves through the case sealer. For medium strength, high strength or double walled boxes, the side bars pivoting inwardly as the box as moves through the case sealer to decrease the angle of attack.

Having described preferred embodiments of the invention, it will be appreciated that various modifications may be made to the structures described above. For example, instead of using pneumatic cylinders to control the various components of the case sealers, it will be appreciated that hydraulic devices or electric motors or solenoids could be used as well. The floating heads may be operated automatically as described above or may be manually lowered and raised to suit the height of the box. Programmable logic controllers are preferred for controlling the various components of the case sealers, but other types of controls could be used as well, such as simple timers. Also, some of the controllers described may be combined in a single controller, and where controllers have been described as performing more than one function, these controllers may be implemented as separate controllers performing one or more functions and exchanging information and control data, as required. Limit switches have been described as the preferred position sensors, but other devices such as photoelectric, infrared or other motion sensors or proximity sensors could be used as well.

As will be apparent to those skilled in the art in light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A case sealer, comprising:

a frame having a longitudinal axis and including an entrance conveyor for moving boxes entering the case sealer along the axis;

a pair of longitudinal spaced-apart, lateral conveyors located to receive boxes from the entrance conveyor;

a floating head spaced above the lateral conveyors, the floating head including:

an upwardly inclined entry ramp adapted to engage and fold inwardly a forward end flap on a box;

means for raising and lowering the floating head to suit the height of the box;

a pivoting arm assembly including a pivot arm pivotable downwardly after the box passes thereunder to fold inwardly a rearward end flap on the box;

a boom extending over the entrance conveyor having a distal end, the pivot arm assembly being slidably mounted on the boom;

means for sliding the pivoting arm assembly along the boom to accommodate and close the end flaps of boxes of varying length;

diverging side bars for engaging and folding inwardly side flaps on the box after the rearward end flap has been folded inwardly; and a seal dispensing platform located downstream of the lateral conveyors, the seal dispensing platform including holding means for holding box flaps shut, the seal dispensing platform being adapted to mount a seal dispenser centrally thereon for sealing the box flaps shut.

2. The case sealer as claimed in claim 1, wherein the means for sliding the pivoting arm assembly along the boom includes an extensible cylinder and a controller for extending and retracting the extensible cylinder to move the pivot arm assembly along the length of the boom to accommodate and close the end flaps of boxes of varying length.

3. The case sealer as claimed in claim 2, wherein the controller for the extensible cylinder extends the pivot arm assembly towards the end of the boom prior to a box being received between the lateral conveyors and prior to the rearward end wall of the box entering the entrance conveyor, the controller retracting the pivot arm assembly away from the end of the boom after the rearward end wall of the box has entered the entrance conveyor.

4. The case sealer as claimed in claim 3, wherein the pivot arm assembly is retracted as the box passes through the lateral conveyors.

5. The case sealer as claimed in claim 4, wherein the pivot arm assembly is retracted at a speed that is the same as a speed of the box moving through the case sealer.

6. The case sealer as claimed in claim 2, further comprising a sensor operatively connected to the controller for determining the length of a box, the controller extending the extensible cylinder to move the pivot arm assembly towards the end of the boom prior a box being received between the lateral conveyors and prior to the rearward end wall of the box entering the entrance conveyor, the controller retracting the extensible cylinder to move the pivot arm assembly away from the end of the boom when the rearward end wall of the box has entered the entrance conveyor.

7. The case sealer as claimed in claim 1, further comprising a sensor switch operatively connected to the means for sliding the pivoting arm assembly along the boom, the sensor switch being activated to move the pivot arm assembly towards the end of the boom prior to a box being received between the lateral conveyors and prior to the rearward end wall of the box entering the entrance conveyor, the sensor switch being deactivated to move the pivot arm assembly away from the end of the boom after the rearward end wall of the box has entered the entrance conveyor.

8. The case sealer as claimed in claim 7, wherein the pivot arm assembly is moved away from the end of the boom at a speed that is the same as a speed of the box moving through the case sealer.

9. The case sealer as claimed in claim 1, wherein the lateral conveyors include:

linking means for linking the lateral conveyors together for movement inwardly and outwardly to match the width of a box passing therethrough;

converging centering conveyor belts forming a throat to center a box therebetween;

means actuatable upon a box contacting both centering conveyor belts for moving the lateral conveyors outwardly while maintaining the box in contact with both centering conveyor belts;

parallel first advancing conveyor belts for receiving a box from the centering conveyor belts; and means for urging the lateral conveyors inwardly for engagement of the first advancing conveyor belts with the box.

* * * * *